US009640005B2

(12) United States Patent
Geerlings et al.

(10) Patent No.: US 9,640,005 B2
(45) Date of Patent: *May 2, 2017

(54) SYSTEMS AND METHODS FOR ADDING A TRAINABLE TRANSCEIVER TO A VEHICLE

(71) Applicant: GENTEX CORPORATION, Zeeland, MI (US)

(72) Inventors: Steven L. Geerlings, Holland, MI (US); Thomas S. Wright, Holland, MI (US); Todd R. Witkowski, Zeeland, MI (US); Bradley R. Hamlin, Allendale, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/618,809

(22) Filed: Feb. 10, 2015

(65) Prior Publication Data

US 2015/0228139 A1 Aug. 13, 2015

Related U.S. Application Data

(60) Provisional application No. 61/938,501, filed on Feb. 11, 2014.

(51) Int. Cl.
*G07C 9/00* (2006.01)
*G08C 17/02* (2006.01)

(52) U.S. Cl.
CPC ..... *G07C 9/00126* (2013.01); *G07C 9/00309* (2013.01); *G07C 9/00857* (2013.01);
(Continued)

(58) Field of Classification Search
CPC ..... G08C 17/02; G08C 2201/20; G07C 2009/00928
See application file for complete search history.

(56) References Cited

U.S. PATENT DOCUMENTS 5,033,112 A 7/1991 Bowling et al.
5,614,891 A 3/1997 Zeinstra et al.
(Continued)

FOREIGN PATENT DOCUMENTS

DE 1020100 15 104 A1 10/2011

OTHER PUBLICATIONS

International Search Report and Written Opinion of the International Searching Authority in PCT/US2015/015262 dated Jul. 2, 2015, 10 pages.

(Continued)

*Primary Examiner* — Nabil Syed
(74) *Attorney, Agent, or Firm* — Foley & Lardner LLP; Bradley D. Johnson

(57) ABSTRACT

A system for installation in a vehicle and for controlling a remote device includes a trainable transceiver and a remote button module. The trainable transceiver base station configured to be mounted in the vehicle at a first location and the remote button module separated from the base station and configured to be mounted in the vehicle at a second location. The remote button module is configured to wirelessly transmit a command signal to the base station in response to receiving a user input at a user input device, and the base station responds to receiving the command signal by transmitting an activation signal to the remote device, wherein the activation signal is formatted to control the remote device.

19 Claims, 28 Drawing Sheets

(52) U.S. Cl.
CPC ..... *G08C 17/02* (2013.01); *G07C 9/00182* (2013.01); *G07C 2009/00769* (2013.01); *G07C 2009/00849* (2013.01); *G07C 2009/00888* (2013.01); *G07C 2009/00928* (2013.01); *G08C 2201/20* (2013.01)

(56) References Cited

U.S. PATENT DOCUMENTS

| | | | | |
|---|---|---|---|---|
| 2004/0185844 | A1* | 9/2004 | Neuman | G07C 9/00182 455/420 |
| 2006/0232376 | A1* | 10/2006 | Blaker | B60R 25/24 340/5.22 |
| 2008/0291047 | A1* | 11/2008 | Summerford | G07C 9/00182 340/5.71 |
| 2010/0134240 | A1* | 6/2010 | Sims | G08C 17/02 340/5.1 |
| 2010/0144284 | A1* | 6/2010 | Chutorash | G08C 17/02 455/66.1 |
| 2012/0003935 | A1 | 1/2012 | Lydon et al. | |
| 2012/0083209 | A1 | 4/2012 | Giles et al. | |
| 2012/0126942 | A1* | 5/2012 | Geerlings | G07C 9/00857 340/5.61 |
| 2015/0099466 | A1* | 4/2015 | Narendra | H04W 76/023 455/41.2 |

OTHER PUBLICATIONS

US Office Action on U.S. Appl. No. 14/618,760 Dtd Mar. 3, 2016.
Final Office Action on U.S. Appl. No. 14/618,760 Dtd Aug. 29, 2016.
International Preliminary Report on Patentability and Transmittal received in PCT/US2015/015262 mailed Aug. 25, 2016, 9 pages.
US Office Action on U.S. Appl. No. 14/618,760 DTD Feb. 2, 2017.

* cited by examiner

SYSTEMS AND METHODS FOR ADDING A TRAINABLE TRANSCEIVER TO A VEHICLE

CROSS-REFERENCE TO RELATED PATENT APPLICATIONS

This application claims the benefit of and priority to U.S. Provisional Application No. 61/938,501, filed Feb. 11, 2014, hereby incorporated by reference in its entirety.

BACKGROUND

The present invention relates generally to the field of trainable transceivers for inclusion within a vehicle. A trainable transceiver generally sends and/or receives wireless signals and may be or include a wireless transceiver. A trainable transceiver may be trained to send a control signal which controls devices (e.g., garage door openers) configured to receive the control signals. Training a trainable transceiver may include providing the trainable transceiver with control information such that a control signal transmitted by the trainable transceiver controls a device associated with the control information. A trainable transceiver may be provided with control information from a control signal sent from an original transmitter (e.g., garage door opener remote) associated with a device (e.g., garage door opener). A trainable transceiver may be incorporated in a vehicle (integrally or contained within the vehicle) and used to control remote devices including garage door openers, lighting systems, gates, etc. Trainable transceivers are generally configured to transmit using radio frequency transmissions over a wide range. Generally, a transceiver configured to transmit over a wide range requires greater power than a transceiver configured to transmit over a short range. A battery powered trainable transceiver for controlling a remote device may therefore be larger than is aesthetically pleasing to transmit over a sufficient distance and last for a sufficient amount of time. It is challenging and difficult to develop trainable transceivers that can operate in a user friendly manner with a variety of vehicles and/or garage door receiver systems.

SUMMARY

One embodiment relates to a system for installation in a vehicle and for controlling a remote device includes a trainable transceiver and a remote button module. The trainable transceiver base station configured to be mounted in the vehicle at a first location and the remote button module separated from the base station and configured to be mounted in the vehicle at a second location. The remote button module is configured to wirelessly transmit a command signal to the base station in response to receiving a user input at a user input device, and the base station responds to receiving the command signal by transmitting an activation signal to the remote device, wherein the activation signal is formatted to control the remote device.

Another embodiment relates to a method for controlling a remote device from a vehicle. The method includes receiving a user input at a user input device of a remote button module, the remote button module located at a first location within the vehicle. In response to receiving the user input, a command signal is wirelessly transmitted from the remote button module to a base station, the trainable transceiver base station located a second location within the vehicle. The method further includes receiving at the base station the command signal from the remote button module, and transmitting, from the base station and using a transceiver circuit of the base station, an activation signal to the remote device. The activation signal is formatted based on the command signal, and the activation signal is formatted to control the remote device.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
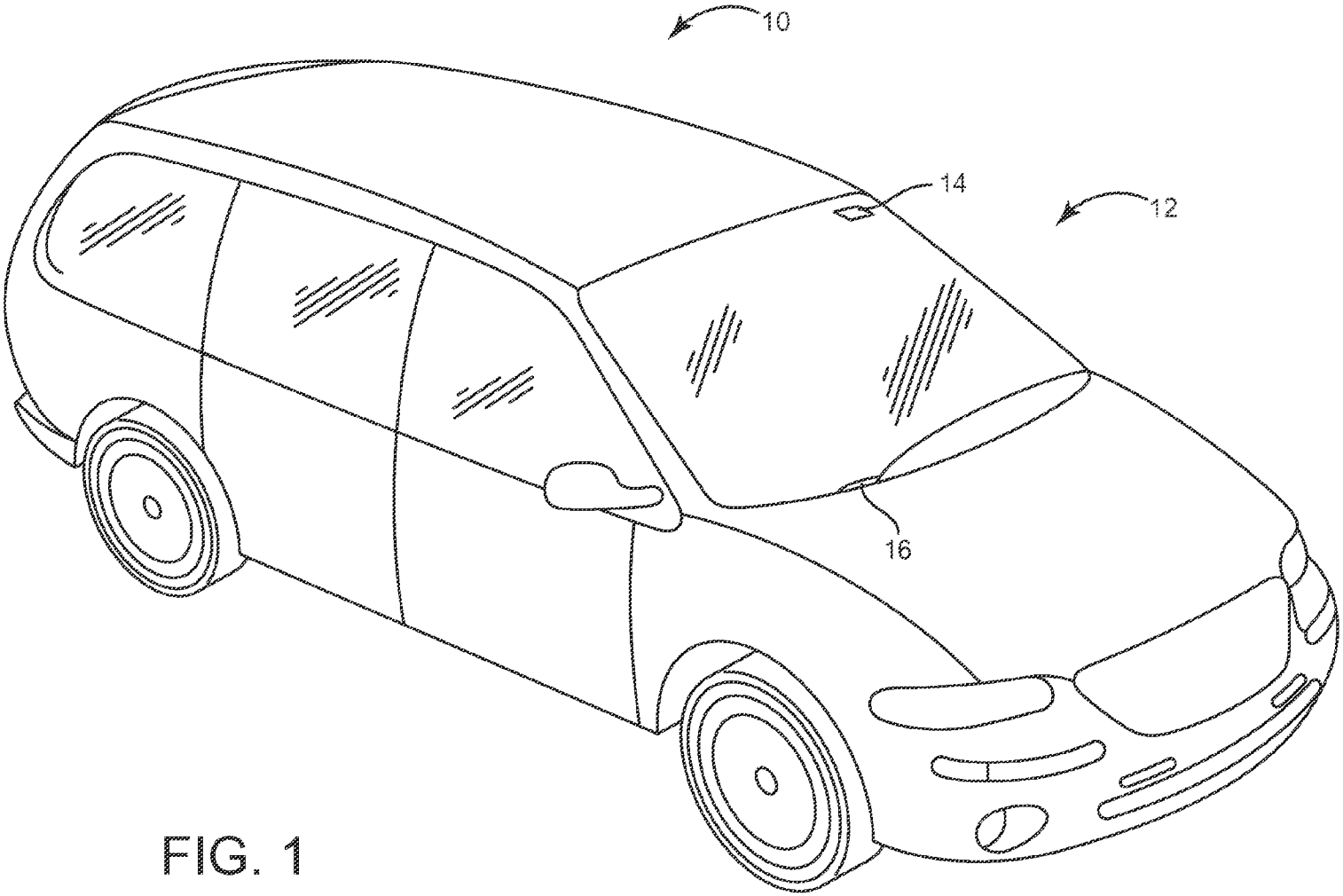
FIG. 1 illustrates an embodiment of a distributed remote system within a vehicle.

Generally, a system for adding a trainable transceiver to a vehicle may operate as a distributed remote system according to the invention includes two components. The first component is a small wireless remote user interface module (e.g., remote button module). The remote button module may be configured to operate with low power consumption. The remote button module wirelessly connects to the second component. The remote button module may send data and/or receive data from the second component. The second component is a base station. The base station may include a trainable transceiver (e.g., trainable transceiver base station). A trainable transceiver is a transceiver which may be configured to send control signals and/or other information to a remote device. The trainable transceiver may be trained by a user to work with particular remote devices and/or home electronic devices (e.g., a garage door opener). For example, a user may manually input control information into the trainable transceiver to configure the trainable transceiver to control the device. A trainable transceiver may also learn control information from an original transmitter. A trainable transceiver may receive a signal containing control information from an original transmitter (e.g., a remote sold with a home electronic device) and determine control information from the received signal. The base station receives data and/or control signals from the remote button module. The base station then transmits the data and/or control signals to a third device. For example, the remote button module may send a control instruction to the base station for activating a garage door opener. The base station may be a HomeLink branded system or trainable transceiver. The base station then transmits a control signal (e.g., to activate the garage door opener) to a wirelessly controlled device (e.g., a garage door opener). The distributed remote system may be added to an existing vehicle by a user and trained to operate a remote device such as a garage door opener.

This distributed remote configuration has an advantage of allowing the remote button module and corresponding hardware components to be packaged in a small housing. The longer range transmitter for communicating with wirelessly controlled devices (e.g., garage door openers) consumes more power than the wireless communication hardware, allowing for communication between the remote button module and the base station. By separating the long range transmitter from the control button, the remote button module may have a small form factor and run on a smaller battery or other power source than if the long range transmitter were included within the same package as the control button. The small and aesthetically pleasing package allows for the remote button module to be mounted in various locations in a vehicle. The distributed remote system also has an advantage of allowing a user to separate an actuation device (e.g., the remote button module) from the transceiver (e.g., the base station). This may facilitate training of the trainable transceiver as discussed herein. A user may also activate the base station and cause it to send a control signal without having physical access to the base station. For example, a user may carry the remote button module on their person and activate a controlled device (e.g., a garage door opener) via the base station by pressing a button on the remote button module. A user may send a control signal from a transceiver without having physical access to the transceiver. The present invention has an additional advantage of allowing removal of the base station from a vehicle to prevent theft of the base station. Additionally, remote buttons and/or base stations may be moved from one vehicle to another, swapped between vehicles, or replaced as a result of the portable nature of the distributed remote system.

FIG. 1 illustrates an embodiment of the distributed remote system 12 within a vehicle 10. The remote button module 14 may be placed, permanently attached, semi-permanently attached, removably attached, or otherwise located within the vehicle 10. In some embodiments, the distributed remote system 12 is added to an existing vehicle. For example, the base station 16 may be inserted into an existing 12 volt power port and the remote button attached to a windshield using adhesive. The distributed remote system 12 may be added to an existing vehicle as a retrofit. For example, the distributed remote system 12 may be added to an existing vehicle that does not have a HomeLink system already installed (e.g., from the factory). The remote button module 14 and base station 16 may be sold as an aftermarket kit. A user may add the distributed remote system 12 to a vehicle. In some embodiments, the distributed remote system 12 may be added to a vehicle without requiring the replacement and/or removal or a vehicle panel. The addition of the distributed remote system 12 may not require a user to perform any modifications to a vehicle wiring system. For example, a user may plug the base station 16 into an existing power port (e.g., 12 volt power port) and attach the remote button module 14 to the windshield of the vehicle 10. Attaching the remote button module 14 to the vehicle 10 may not require the removal, modification, and/or replacement of a vehicle panel. For example, the remote button module 14 may be attached to the windshield of the vehicle 10 as illustrated in FIG. 1. The remote button module 14 may be attached or otherwise located at various positions within the vehicle 10. For example, the remote button module 14 may be attached to a side window, steering wheel, steering column, dashboard, center counsel, head liner, visor, center stack, seat, etc. In some embodiments, the remote button module 14 may include a custom bezel that mimics the style of a specific vehicle interior. In other embodiments, the remote button module 14 may be configured to allow for a bezel to attach to the remote button module 14. For example, the bezel may snap over the remote button module 14, attach to a slot and/or groove of the remote button module 14, etc.

In some embodiments, the remote button module 14 is attached to a location within the vehicle 10 using one or more of a pressure-sensitive adhesive, adhesive, glue, Velcro, foam tape, double sided tape, a magnet included within the remote button module 14 (or a carrier thereof), magnetic tape, etc. In other embodiments, the remote button module 14 is attached to a carrier as discussed herein. For example, the remote button module 14 may snap into the carrier or slide into a grove or slot of the carrier. The carrier may secure the remote button module 14. In some embodiments, the carrier is attached to a surface of the vehicle with adhesive. In other embodiments, one or more of the above described attachment techniques and/or materials with reference to the remote button module 14 are used to secure the carrier.

With continued reference to FIG. 1, the trainable transceiver base station 16 may be placed, permanently attached, semi-permanently attached, removably attached, or otherwise located within the vehicle 10. The base station 16 may be added to a vehicle by a user to retrofit the vehicle. This may add HomeLink capabilities to a vehicle without a HomeLink system already installed. The base station 16 may be part of an aftermarket kit. In some embodiments, the base station 16 may added to a vehicle without requiring the removal of and/or replacement of a vehicle panel. The base station 16 may be added without requiring a user to modify the wiring of the vehicle. For example, the base station 16 may be plugged into an existing 12 volt power port included with the vehicle. In some embodiments, the base station 16 is configured to attach to and be partially, or wholly inserted into a 12 volt power port or cigarette lighter of a vehicle. For example, the base station 16 may be plugged into and supported by a 12 volt power port located in the center stack of the vehicle 10 as illustrated in FIG. 1. The 12 volt power port may be a constant on power source such as a console counted power source and/or an automatic power off (APO) power source. An APO power source may prevent a vehicle battery from being depleted by the base station 16. A constant on and/or APO power source may have a voltage other than 12 volts. In some embodiments, the base station 16 connects to center stack ignition on only power source which provides power to the base station 16 only when the ignition of the vehicle is on. In other embodiments, the base station 16 may be configured to attach to one or more of a Universal Serial Bus (USB) port (e.g., standard A, standard B, mini, micro, etc.). In further embodiments, the base station 16 is configured to attach to varying other types of power outlets. In still further embodiments, the base station 16 is powered by a local rechargeable battery and may be located anywhere within, on, or otherwise connected with the vehicle. In additional embodiments, the base station 16 is wired directly to one or more systems of the vehicle (e.g., power system).

Figure 2A:
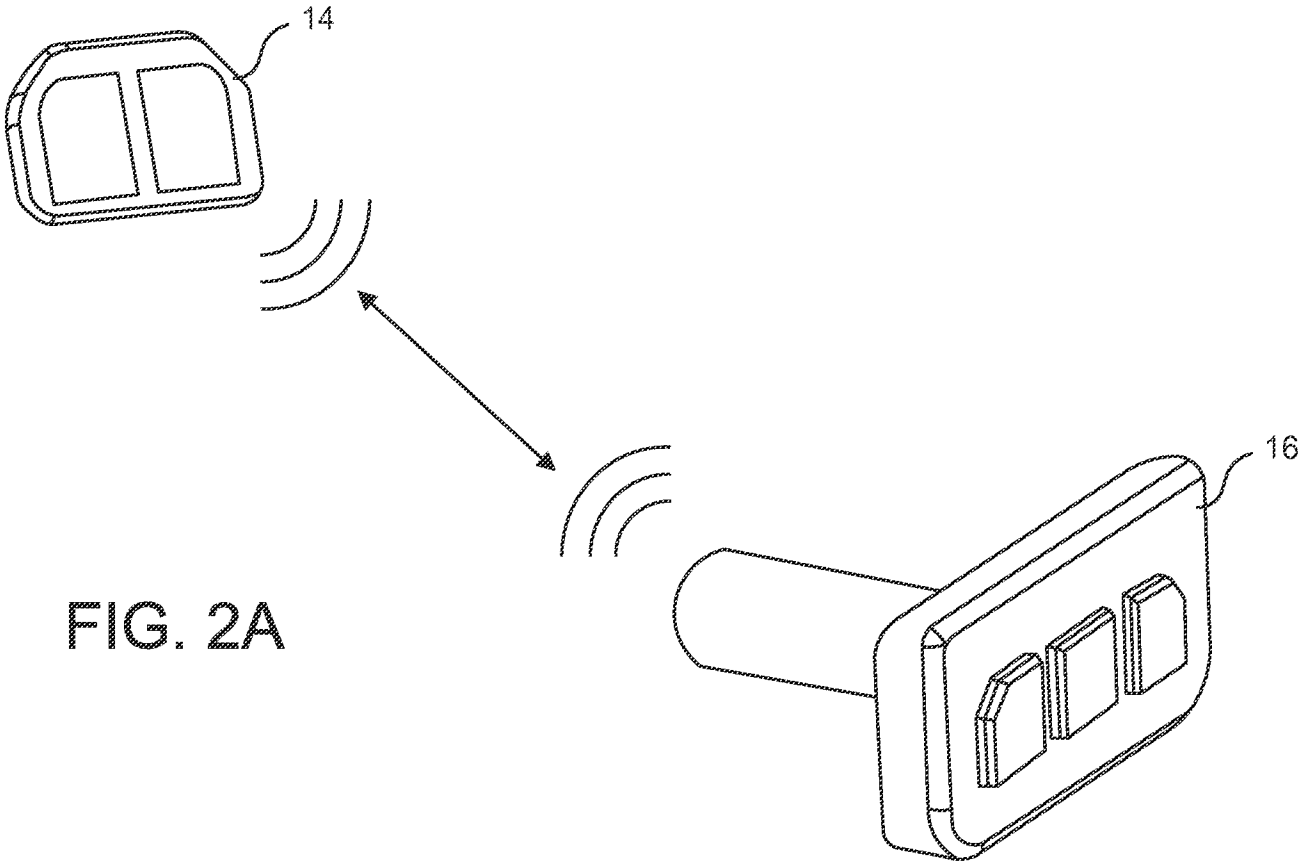
FIG. 2A illustrates an exemplary embodiment of the distributed remote system with a remote user interface module in communication with a trainable transceiver base station.

FIG. 2A illustrates an exemplary embodiment of the distributed remote system 12 with the remote button module 14 in communication with the base station 16. The remote user interface module and base station 16 may communication with a variety of wireless communications techniques. In one embodiment, the remote button module 14 and base station 16 communicate using radio frequency transmissions. The remote button module 14 and base station 16 can communicate using one or more Industrial, Scientific, and Medical (ISM) bands (e.g., the band at 2.4 GHz) using one or more Bluetooth protocols (e.g., v2.0, v3.0, v4.0, etc.). In other embodiments, the remote button module 14 and base station 16 communicate using other radio frequencies. In further embodiments, the remote button module 14 and base station 16 may communication using one or more of infrared transmissions, optical transmissions, or other wireless digital or analog transmission medium. Wireless communication of the type just described may be carried out using hardware components including a circuit having a Bluetooth transceiver chip and a microprocessor, a Bluetooth System on a Chip (SoC), Bluetooth Low Energy (BLE) SoC, a transmitter or transmitters, a receiver or receivers, a transceiver or transceivers, of another communication system architecture.

In some embodiments, the communication between the remote button module 14 and the base station 16 is encrypted or otherwise secured. In one embodiment, the remote button module 14 and base station 16 communicate using an Advanced Encryption Standard (AES). Certain embodiments may utilize encryption techniques and/or standards such as ISO/IEC 18033-3, AES 128 bit encryption, a rolling code, a hopping code, fixed code, KeeLoq, or other security or encryption techniques.

In further embodiments, the distributed remote system 12 includes additional security features. In one embodiment, the remote button module 14 includes a finger print scanner/reader. A user may be prevented from using the remote button module 14 if the scanned/read fingerprint does not match a corresponding print stored in the memory of the remote button module 14. The base station 16 may also include a fingerprint scanner/reader in addition to or in place of a fingerprint scanner/reader in the remote button module 14. In other embodiments, the distributed remote system 12 uses two-step verification (e.g., multi-factor authentication). This may require a user to have another device (e.g., a mobile computing device such as a laptop or mobile phone) connected to the distributed remote system 12 (e.g., one or more of the remote button module 14 and base station 16).

Figure 2B:
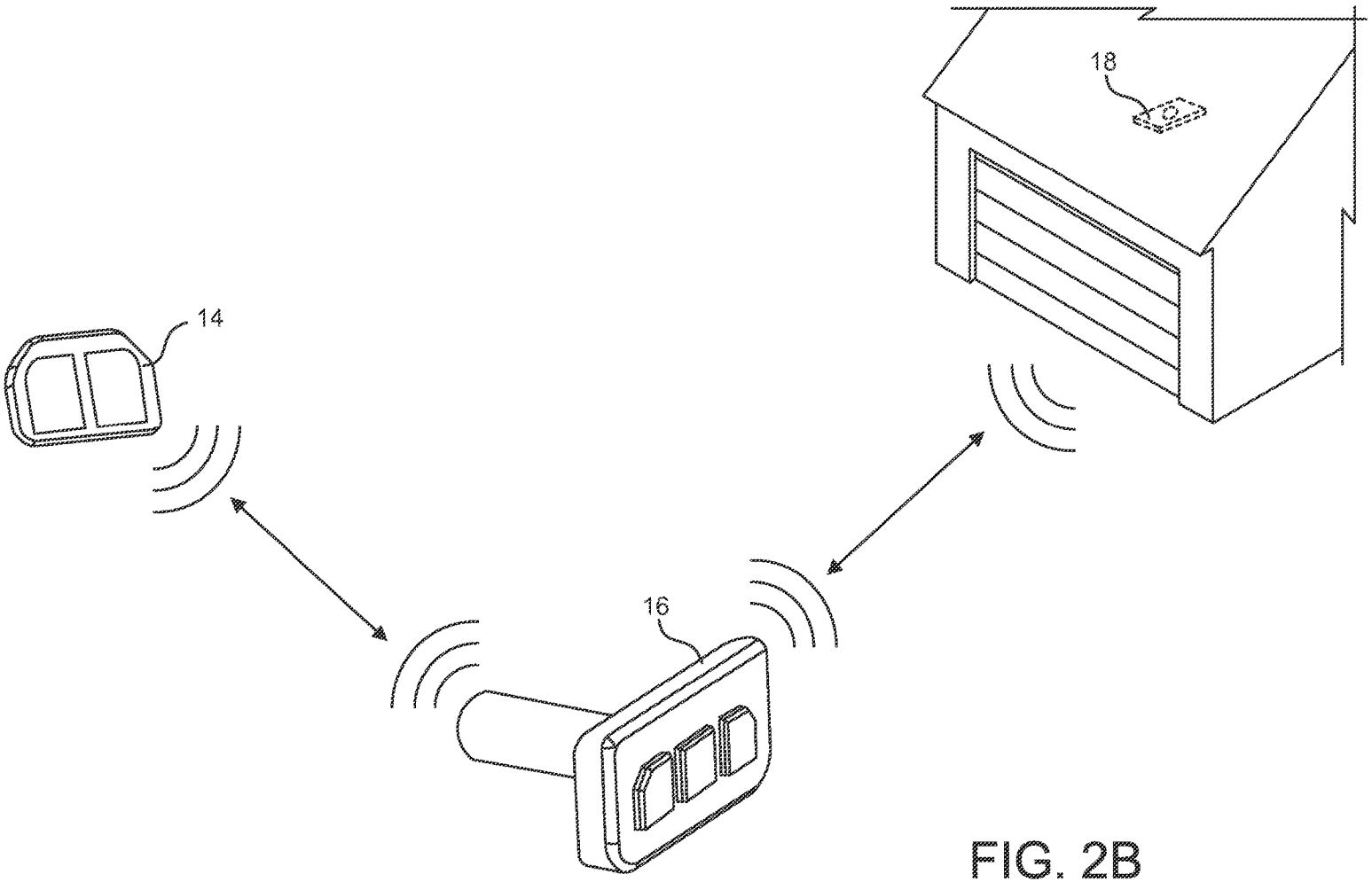
FIG. 2B illustrates as exemplary embodiment of the distributed remote system, including a remote button module and base station, in communication with an additional device.

FIG. 2B illustrates as exemplary embodiment of the distributed remote system 12 in communication with an additional device 18. The additional device 18 may be a home electronic device and/or remote device. The home electronic device may be a garage door opener as illustrated in FIG. 2B. In one embodiment, the distributed remote system 12 communicates with the additional device 18 (e.g., home electronic device) using a transmitter, receiver, and/or transceiver located in the base station 16. In some embodiments the base station 16 and the additional device 18 (e.g., a home electronic device or remote device such as a garage door opener) communicate using frequencies in the ultra-high frequency range, typically between 260 and 960 megahertz (MHz) although other frequencies may be used.

The base station 16 of the distributed remote system 12 may communicate wirelessly with additional devices 18. One or more of the communications techniques and/or devices described above with reference to FIG. 2A may be used. For example, the base station 16 may include a radio frequency transceiver to transmit and/or receive radio frequency transmissions related to the garage door opener. In some embodiments, the base station 16 of the distributed remote system 12 communicates with additional devices 18 using encryption techniques. One or more of the encryption techniques described above with reference to FIG. 2A may be used. For example, the base station 16 may communicate with the garage door opener using a rolling code or fixed code. In other embodiments, the remote button module 14 may use different communication and/or encryption techniques. For example, the remote button module 14 may communicate with the base station 16 using a Bluetooth protocol and the base station 16 may communicate with a home electronic device (e.g., a garage door opener) using a radio frequency transmitter and a rolling code.

In other embodiments, the remote user interface module may communicate directly with additional devices using one or more of the techniques and or components described herein. For example, the remote user interface module (e.g., remote button module 14) may communicate directly with a garage door opener using a radio frequency transceiver.

Figure 3:
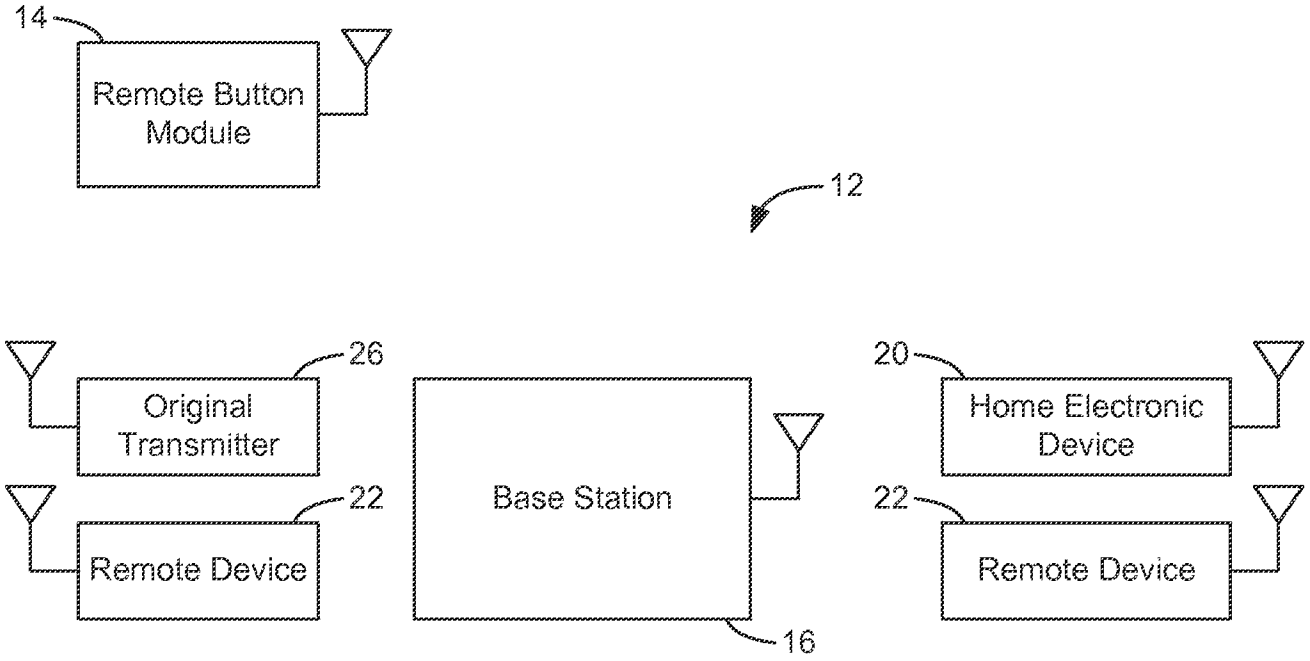
FIG. 3 illustrates a base station in communication with home electronic devices, remote devices, original transmitters, and/or one or more remote button modules according to an exemplary embodiment.

Referring now to FIG. 3, in an exemplary embodiment, the base station 16 transmits a control signal to a home electronic device 20 and/or remote device 22. For example, the base station 16 may transmit a control signal to a garage door opener. The trainable transceiver base station 16 may be in communication with (e.g., send and receive transmissions, data, control instructions, control signals, etc.) with home electronic devices 20, remote devices 22, original transmitters 26, and/or one or more remote button modules 14. The base station 16 may transmit a control signal to an additional device. The additional device may be a home electronic device and/or a remote device. The remote button module 14 may transmit a triggering signal to the base station 16. This may affect the base station 16 to transmit the control signal to the additional device. In some embodiments, a second button on the remote button module 14 may affect the remote button module 14 to send a different triggering signal to the base station 16. The different triggering signal may affect the base station 16 to send a control signal to a different home electronic device 20 and/or remote device 22. For example, the first button on the remote button module 14 may affect the base station 16 to send a control signal to a garage door opener while the second button on the remote button module 14 may affect the base station 16 to send a control signal to a home lighting system. Home electronic devices 20 may be any device configured to send and/or receive wireless transmissions and located within, attached to, or near a home. For example, home electronic device 20 may include a garage door opener, media controller, media devices (e.g., radio, television, etc.), lighting controller, light fixtures, irrigation system, outdoor lights, electrical sockets, kitchen appliances, personal computers, home networking devices, etc. Remote devices 22 may be any portable device configured to send and/or receive wireless transmissions. For example, remote devices may include portable telephones, smart phones, tablets, laptop computers, personal digital assistants, vehicles, or other devices not physically connected such that they are not readily movable. Remote devices 22 may include portable devices.

The base station 16 may also be in communication with an original transmitter 26. An original transmitter 26 is a remote that is intended to work with a home electronics device 20 or remote device 22. For example, an original transmitter 26 may include a remote which is provided with a home electronics device 20 or remote device 22 (e.g., packaged with a product at the point of purchase by a consumer). Original transmitters 26 may alternatively be remotes which are user programmed to communicate with home electronic devices 20 or remote devices 22. For example, an original transmitter 26 may be a universal remote programmed or trained by a user to communicate with a home electronic device 20 or remote device 22. In one embodiment, the base station 16 is trained using the communication between the base station 16 and the original transmitter 26. For example, a trainable transceiver base station 16 (e.g., a HomeLink branded system) may learn control information for sending a control signal from a transmission received from an original transmitter 26.

In some embodiments, the remote button module 14 is configured for communication only with one or more base stations 16. In other embodiments, the remote button module 14 may communicate with an original transmitter 26. For example, the remote button module 14 may be in communication with an original transmitter 26 for the purposes of training the distributed remote system 12. In further embodiments, the remote button module 14 may be in communication with a remote device 22. For example, the remote button module 14 may send to and/or receive data from a smart phone. This may facilitate training of the distributed remote system 12, be used to implement security procedures (e.g., two-step identification), send a control signal to another device using the remote device, display and/or transfer application data or other data, etc. In other embodiments, the remote button module 14 may also communicate, at times with one or more home electronic device 20 and/or remote device 22. For example, the remote button module 14 may communicate with a home electronic device 20 and/or remote device 22 during training of the distributed remote system 12.

In one embodiment, during normal operation (e.g., post-training, post-pairing, post-setup, or when the base station 16 is otherwise ready to send a control signal to a remote device 22 and/or home electronic device 20) the base station 16 receives an input from the remote button module 14. The input may be data, a command instruction to relay to another device, and/or other information. The remote button module 14 may send the base station 16 an input to operate another device by sending a command instruction. For example, when a button on the remote button module 14 is pushed it may result in the remote button module 14 sending an input to the base station 16 using BLE. In response to the input, the base station 16 sends a command instruction to a third device using a transceiver and the appropriate communication protocol. Sending a command instruction may include the base station 16 determining the proper protocol and or transmission frequency, applying security protocols (e.g., checking a rolling code data set stored in memory), or the base station 16 otherwise formatting the control signal. Continuing the example, the input sent by the button to the base station 16 may provide information to the base station 16 that a button has been pushed on the remote button module 14. The base station 16 may process this input and determine that the input corresponds to sending a command instruction to raise or lower a garage door by activating a garage door opener. The base station 16 then selects the proper transmission characteristics (e.g., applying the rolling code security protocol associated with the device to be controlled, the frequency, etc.) and generates a command instruction. The command instruction may be for the garage door opener to turn on. The instruction is then sent to the garage door opener.

In other embodiments, the remote button module 14 may perform additional tasks (e.g., selecting and/or applying a security protocol for the device to be controlled). The remote button module 14 may send a command instruction to the base station 16. The base station 16 may then use the onboard transceiver, which may have greater power and/or range, to forward the command instruction to the device to be controlled. For example, the remote button module 14 generates a command instruction for a garage door opener to be activated. The command instruction is then transmitted to the base station 16. The base station 16 receives the command instruction and repeats it (e.g., with or without further encryption or other transformation) by transmitting it at greater power and/or range to the garage door opener. Advantageously, this may provide the remote control system greater range than if the remote button module 14 was used alone to control home electronic devices and/or remote devices. In some embodiments, the base station 16 may also include more memory allowing for the storage of a greater amount of information such as control information, encryption codes, pairing information, identification information, a device registry, data from a home electronic device 20 and/or remote device 22, applications and/or application data, programs, and/or other data related to devices and functions described herein. The remote system may therefore provide an advantage by including more data storage capacity than if a single device or just a remote button module 14 were used. Storing additional device and/or communications information may also allow for the system to be compatible with more home electronic devices 20, remote devices 22, and/or original transmitters 26.

Figure 4A:
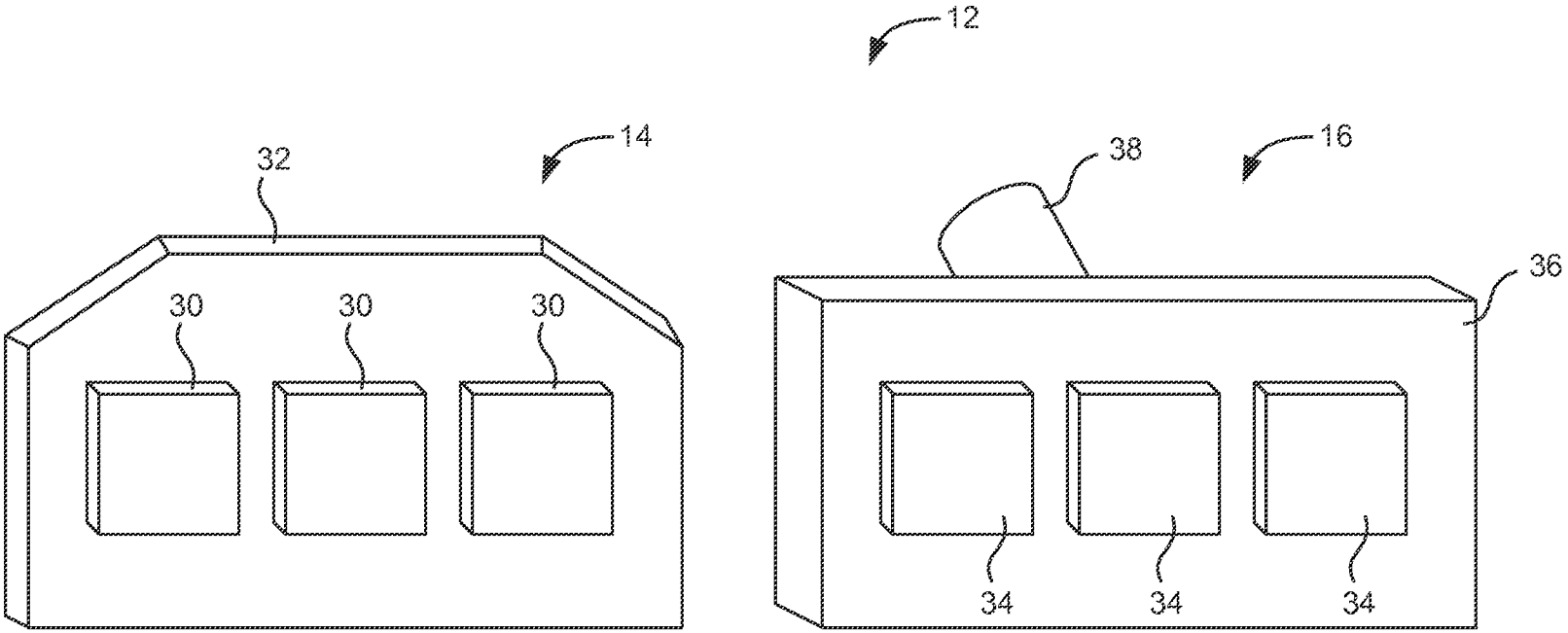
FIG. 4A illustrates a remote button module and a trainable transceiver base station according to one embodiment.

FIG. 4A illustrates a remote user interface module and a base station 16 according to one embodiment. The remote button module 14 may have a chamfered rectangular shape. The remote button module 14 may include three buttons 30 for receiving user input. In some embodiments, the buttons 30 are hard key buttons. In other embodiments, the buttons 30 are soft keys (e.g., capacitive touch buttons or resistive touch buttons). In other embodiments, the remote button module 14 may include other numbers of buttons 30. For example, the remote button module 14 may include one button 30, two buttons 30, three buttons 30, etc. In one embodiment, the remote button module 14 has a thin profile. For example, the remote button module 14 may have a width of between five and seven millimeters. In some embodiments, the buttons 30 on the remote button module 14 may be flush with the housing 32 of the remote button module 14. This may provide an integrated appearance. In other embodiments, the buttons 30 may extend from the housing 32 of the remote button module 14.

The trainable transceiver base station 16 may include three buttons 34 to receive user input. The buttons 34 may be configured as described above with reference to the remote button 34 module 14. This provides an advantage to a user in that the user may send a control signal to a home electronic device and/or remote device by pressing a button 34 on either the base station 16 or the remote button 34 module 14. For example, a user which has forgotten the remote button 34 module 14 may still control a remote device and/or home electronic device using the input devices included in the base station 16. In some embodiments, the base station housing 36 has a rectangular shape as illustrated in FIG. 4A. In other embodiments, the base station housing 36 has other shapes such as rectangles of various dimensions, hemispheres, spheres, cubes or various dimensions, geometric shapes, a combination of some or all of the preceding, or other appearance. The base station 16 may include a connection 38 compatible with a 12 volt power port (e.g., cigarette lighter). The connection 38 may provide support for the base station 16 and/or form an electrical connection with the vehicle. In some embodiments, the connection 38 is configured such that the base station 16 is flush with a vehicle surface upon connection with the 12 volt power port. In other embodiments, the connection 38 may extend out of the 12 volt power port when connected. In further embodiments, the connection 38 may include features such as extenders, hinges, locks, etc. which allow a user to reposition the housing 36 of the base station 16 relative to the 12 volt power port which the base station 16 is connected to the 12 volt power port.

Figure 4B:
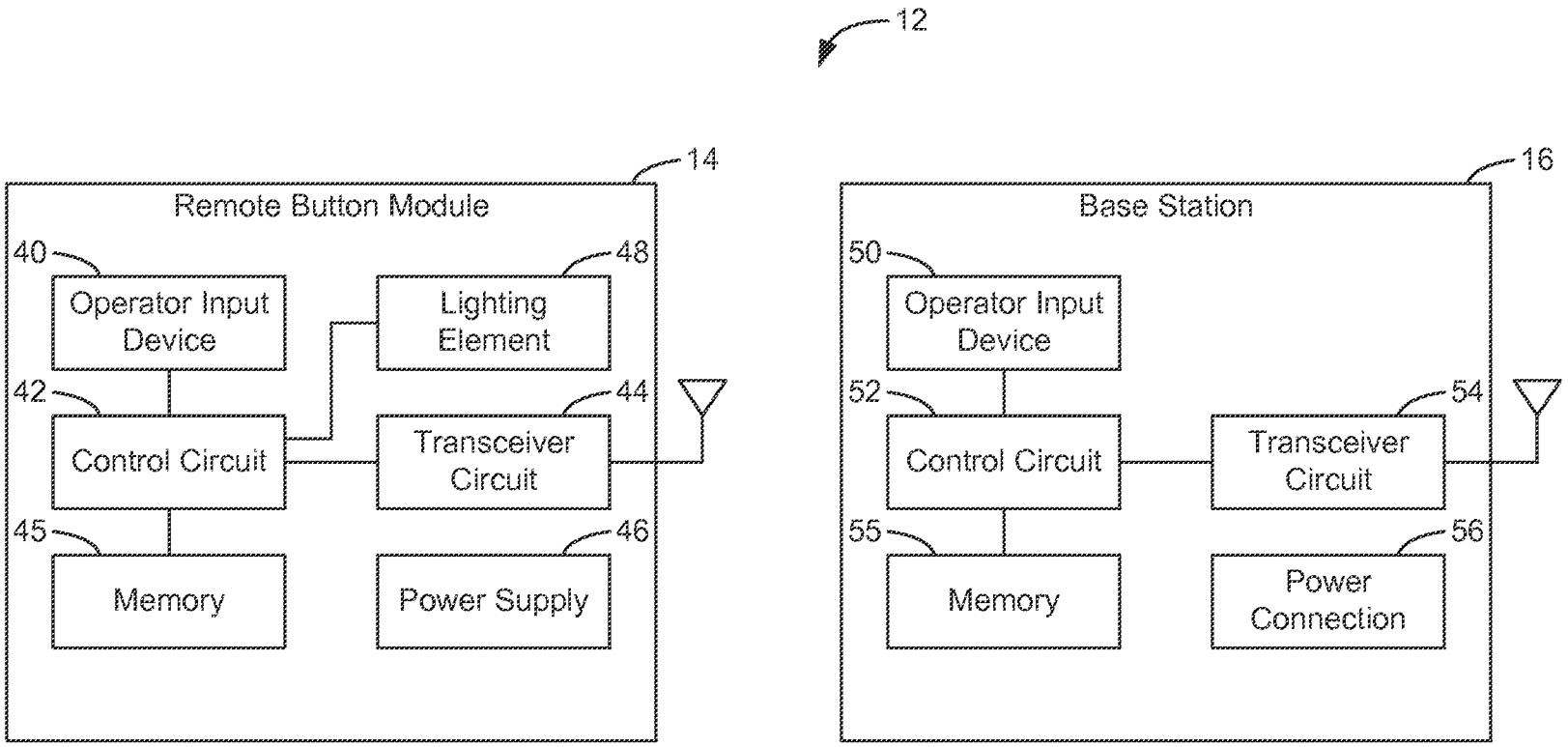
FIG. 4B illustrates one embodiment of hardware components included in the remote user interface module and the base station which correspond to the embodiment illustrated in FIG. 4A.

FIG. 4B illustrates one embodiment of hardware components included in the remote button module 14 and the base station 16 which correspond to the embodiment illustrated in FIG. 4A. In one embodiment, the remote button module 14 includes an operator input device 40. The operator input device 40 may be one or more buttons as illustrated in FIG. 4A. In some embodiments, the operator input device 40 may include input devices such as touchscreen displays, switches, microphones, knobs, touch sensor (e.g., projected capacitance sensor resistance based touch sensor, resistive touch sensor, or other touch sensor), proximity sensors (e.g., projected capacitance, infrared, ultrasound, infrared, or other proximity sensor), or other hardware configured to generate an input from a user action. In additional embodiments, the operator input device 40 may display data to a user or other provide outputs. For example, the operator input device 40 may include a display screen (e.g., a display as part of a touchscreen, liquid crystal display, e-ink display, plasma display, light emitting diode (LED) display, or other display device), speaker, haptic feedback device (e.g., vibration motor), LEDs, or other hardware component for providing an output. In some embodiments, the operator input device 40 is connected to the control circuit 42. The control circuit 42 may send information and or control signals or instructions to the operator input device 40. The control circuit 42 may also receive input signals, instructions, and/or data from the operator input device 40.

The control circuit 42 may include various types of control circuitry, digital and/or analog, and may include a microprocessor, microcontroller, application-specific integrated circuit (ASIC), or other circuitry configured to perform various input/output, control, analysis, and other functions to be described herein. In other embodiments, the control circuit 42 may be a SoC individually or with additional hardware components described herein. The control circuit 42 may further include, in some embodiments, memory (e.g., random access memory, read only memory, flash memory, hard disk storage, flash memory storage, solid state drive memory, etc.). In further embodiments, the control circuit 42 may function as a controller for one or more hardware components included in the remote button module 14. For example, the control circuit 42 may function as a controller for a touchscreen display or other operator input device 40, a controller for a transceiver, transmitter, receiver, or other communication device (e.g., implement a Bluetooth communications protocol).

In some embodiments, the control circuit 42 receives inputs from operator input devices 40 and processes the inputs. The inputs may be converted into control signals, data, inputs to be sent to the base station 16, etc. The control circuit 42 controls the transceiver circuit 44 and uses the transceiver circuit 44 to communicate with the base station 16. The control circuit 42 may also be used to pair the remote user interface module with the trainable transceiver base station 16.

The control circuit 42 is coupled to memory 45. The memory 45 may be used to facilitate the functions of the remote button module 14 and/or distributed remote system 12 described herein. Memory 45 may be volatile and/or non-volatile memory 45. For example, memory 45 may be random access memory, read only memory, flash memory, hard disk storage, flash memory storage, solid state drive memory, etc. In some embodiments, the control circuit 42 reads and writes to memory 45. Memory 45 may include computer code modules, data, computer instructions, or other information which may be executed by the control circuit 42 or otherwise facilitate the functions of the remote button module 14 and/or distributed remote system 12 described herein. For example, memory 45 may include encryption codes, pairing information, identification information, a device registry, etc.

The remote button module 14 may further include a transceiver coupled to the control circuit 42. The transceiver allows the remote button module 14 to transmit and/or receive wireless communication signals. The wireless communication signals may be transmitted to or received from a variety of wireless devices as described with reference to FIG. 3. In one embodiment, the transceiver allows the remote button module 14 to communicate with the base station 16. For example, the transceiver may receive information such as pairing information (e.g., pairing requests from a base station 16, pairing encryption information, etc.), status information regarding the base station 16 and/or a device controlled by or in communication with the base station 16 (e.g., whether a garage door is open or closed), etc. The transceiver may also send information, instructions, inputs, control signals, etc. to the base station 16. For example, the remote user interface module may send the base station 16 an input corresponding to an operator input device 40 being actuated by a user, information about the power remaining in a battery of the remote button module 14, a control signal (e.g., close a garage door or turn on a garage door opener), etc. The transceiver may be controlled by the control circuit 42. For example, the control circuit 42 may turn on or off the transceiver (e.g., when the remote button module 14 is not paired with a base station 16 and a pairing sequence has not been initiated, the control circuit 42 may disable the transceiver), the control circuit 42 may send data using the transceiver, etc. Inputs from the transceiver may also be received by the control circuit 42. In some embodiments, the transceiver may include additional hardware such as processors, memory 45, integrated circuits, antennas, etc. The transceiver may process information prior to transmission or upon reception and prior to passing the information to the control circuit 42. In some embodiments, the transceiver may be coupled directly to memory 45 (e.g., to store encryption data, retrieve encryption data, etc.). In further embodiments, the transceiver may include one or more transceivers, transmitters, receivers, etc. For example, the transceiver may include an optical transceiver, near field communication (NFC) transceiver, etc. for pairing with a base station 16 and a BLE transceiver for communicating with a paired base station 16 or other device. In some embodiments, the transceiver may be implemented as a SoC.

The remote button module 14 further includes a power source 46. In some embodiments, the power source 46 is or includes a battery. In other embodiments, one or more different power sources 46 may be used in combination. For example, the power source 46 may include one or more of solar cells, capacitors, batteries (e.g., a lithium-ion battery, coin cell battery, etc.), wireless charging mechanism (e.g., inductive charging coils), USB charging port, wired connection to a power supply outside of the remote button module 14 housing, a power source 46 recharged by the movement of the vehicle (e.g., an inductive charging component or an eccentric weight and ratcheted winding mechanism), etc. The power source 46 may be connected to one or more hardware components of the remote button module 14.

In some embodiments, the remote button module 14 further includes one or more lighting elements 48. The lighting element 48 may be connected to and/or controlled by the control circuit 42. In some embodiments, lighting element 48 is one or more light emitting diodes (LEDs). In other embodiments, the lighting element 48 is one or more of LEDs, a backlight, luminescent material, incandescent light source, a display screen or touchscreen, or other light source. In some embodiments, lighting element 48 may be a decorative light. In other embodiments, lighting element 48 may perform a function such as providing light at a predetermined ambient light level, providing information to a user, providing backlighting, locating the remote button module 14, communicating information to the base station 16 or other device, and/or other function described herein.

With continued reference to FIG. 4B, an embodiment of the hardware components of the base station 16 is illustrated. The embodiment of the hardware components illustrated in FIG. 4B corresponds to the embodiment of the trainable transceiver base station 16 illustrated in FIG. 4A. In one embodiment, the base station 16 includes similar or the same components as those discussed with reference at the remote button module 14. In some embodiments, the base station 16 includes an operator input device 50. The operator input device 50 may be one or more buttons as illustrated in FIG. 4A. In some embodiments, the operator input device 50 may include input devices such as touchscreen displays, switches, microphones, knobs, touch sensor (e.g., projected capacitance sensor resistance based touch sensor, etc.), proximity sensors (e.g., projected capacitance, infrared, ultrasound, etc.), etc. In additional embodiments, the operator input device 50 may display data to a user or other provide outputs. For example, the operator input device 50 may include a display screen (e.g., a display as part of a touchscreen, liquid crystal display, e-ink display, plasma display, light emitting diode (LED) display, etc.), speaker, haptic feedback device (e.g., vibration motor), LEDs, etc. In some embodiments, the operator input device 50 is connected to the control circuit 52. The control circuit 52 may send information and or control signals or instructions to the operator input device 50. The control circuit 52 may also receive input signals, instructions, and/or data from the operator input device 50.

The base station 16 further includes control circuitry. The control circuit 52 may include various types of control circuitry, digital and/or analog, and may include a microprocessor, microcontroller, application-specific integrated circuit (ASIC), or other circuitry configured to perform various input/output, control, analysis, and other functions to be described herein. In other embodiments, the control circuit 52 may be a SoC individually or with additional hardware components described herein. The control circuit 52 may further include, in some embodiments, memory (e.g., random access memory, read only memory, flash memory, hard disk storage, flash memory storage, solid state drive memory, etc.). In further embodiments, the control circuit 52 may function as a controller for one or more hardware components included in the remote button module 14. For example, the control circuit 52 may function as a controller for a touchscreen display or other operator input device 50, a controller for a transceiver, transmitter, receiver, or other communication device (e.g., implement a Bluetooth communications protocol).

The base station 16 may further include memory 55. The memory 55 may be used to facilitate the functions of the base station 16 and/or distributed remote system 12 described herein. Memory 55 may be volatile and/or non-volatile memory. For example, memory 55 may be random access memory, read only memory, flash memory, hard disk storage, flash memory storage, solid state drive memory, etc. In some embodiments, the control circuit 52 reads and writes to memory 55. Memory 55 may include computer code modules, data, computer instructions, or other information which may be executed by the control circuit 52 or otherwise facilitate the functions of the remote button module 14 and/or distributed remote system 12 described herein. For example, memory 55 may include encryption codes, pairing information, identification information, a device registry, user preferences, user settings, etc.

The base station 16 may further include a transceiver circuit 54. The transceiver circuit 54 allows the base station 16 to transmit and/or receive wireless communication signals. The wireless communication signals may be transmitted to or received from a variety of wireless devices as described with reference to FIG. 3. In one embodiment, the transceiver circuit 54 allows the base station 16 to communicate with the remote button module 14. For example, the transceiver circuit 54 may receive information such as pairing information (e.g., pairing requests from a remote button module 14, pairing encryption information, etc.), status information regarding the remote button module 14 such as remaining battery life and/or a device connected to the remote button module 14 (e.g., whether a smart phone is connected to the remote button module 14), etc. The transceiver circuit 54 may also send information, instructions, inputs, control signals, etc. to the remote button module 14. For example, the base station 16 may send the remote button module 14 information about a device controlled by or in communication with the base station 16 (e.g., the status of a garage door opener, status of lights, status of gates, etc.), etc. The transceiver circuit 54 may also send signals to devices controlled by or in communication with the base station 16 and/or receive signals from devices controlled by or in communication with the base station 16. For example, the transceiver circuit 54 of the base station 16 may be more powerful and/or have a greater range than the transceiver in the remote button module 14. The base station 16 may be configured to draw power from the vehicle or other source which advantageously allows the base station 16 to consume more power than the remote button module 14 when transmitting to other devices. The signal sent by the transceiver circuit 54 to devices controlled or otherwise in communication with the base station 16 may be encrypted using the transceiver circuit 54 and associated components and/or with additional components of the base station 16 (e.g., the control circuit 52 and memory). The base station 16 may send a control signal and/or data to a home electronic device and/or remote device using the transceiver circuit 54.

The transceiver circuit 54 may be controlled by the control circuit 52. For example, the control circuit 52 may turn on or off the transceiver circuit 54 (e.g., when the base station 16 is not paired with a remote button module 14 and a pairing sequence has not been initiated, the control circuit 52 may disable the transceiver), the control circuit 52 may send data using the transceiver, etc. Inputs from the transceiver circuit 54 may also be received by the control circuit 52. In some embodiments, the transceiver may include additional hardware such as processors, memory, integrated circuits, antennas, etc. The transceiver circuit 54 may process information prior to transmission or upon reception and prior to passing the information to the control circuit 52. In some embodiments, the transceiver circuit 54 may be coupled directly to memory 55 (e.g., to store encryption data, retrieve encryption data, etc.). In further embodiments, the transceiver circuit 54 may include one or more transceivers, transmitters, receivers, etc. For example, the transceiver circuit 54 may include an optical transceiver, near field communication (NFC) transceiver, etc. for pairing with a remote button module 14 and a BTE transceiver for communicating with a paired remote button module 14 or other device. In some embodiments, the transceiver circuit 54 may be implemented as a SoC.

The base station 16 may further include a power connection 56. The power connection 56 may be a connection allowing the base station 16 to be in electrical communication with a 12 volt power port (e.g., cigarette lighter) as illustrated in FIG. 4A. In other embodiments, the power connection 56 is a USB connector allowing the base station 16 to be in electrical communication with a USB port. For example, the power connection 56 may be a USB cable with a male adapter. In some embodiments, the power connection 56 is or includes a battery. In other embodiments, one or more different power sources may be used in combination with or in place of the power connection 56. For example, the power source may include one or more of solar cells, capacitors, batteries (e.g., a lithium-ion battery), wireless charging mechanism (e.g., inductive charging coils), USB charging port, wired connection to a power supply (e.g., direct wiring coupling the base station 16 to a vehicle power supply), a power source recharged by the movement of the vehicle (e.g., an inductive charging component or an eccentric weight and ratcheted winding mechanism), etc. The power supply may be connected to one or more hardware components of the base station 16. Power connection 56 may serve as a power source for base station 16. Power connection 56 may receive power from a power source external or internal to base station 16.

Figure 4C:
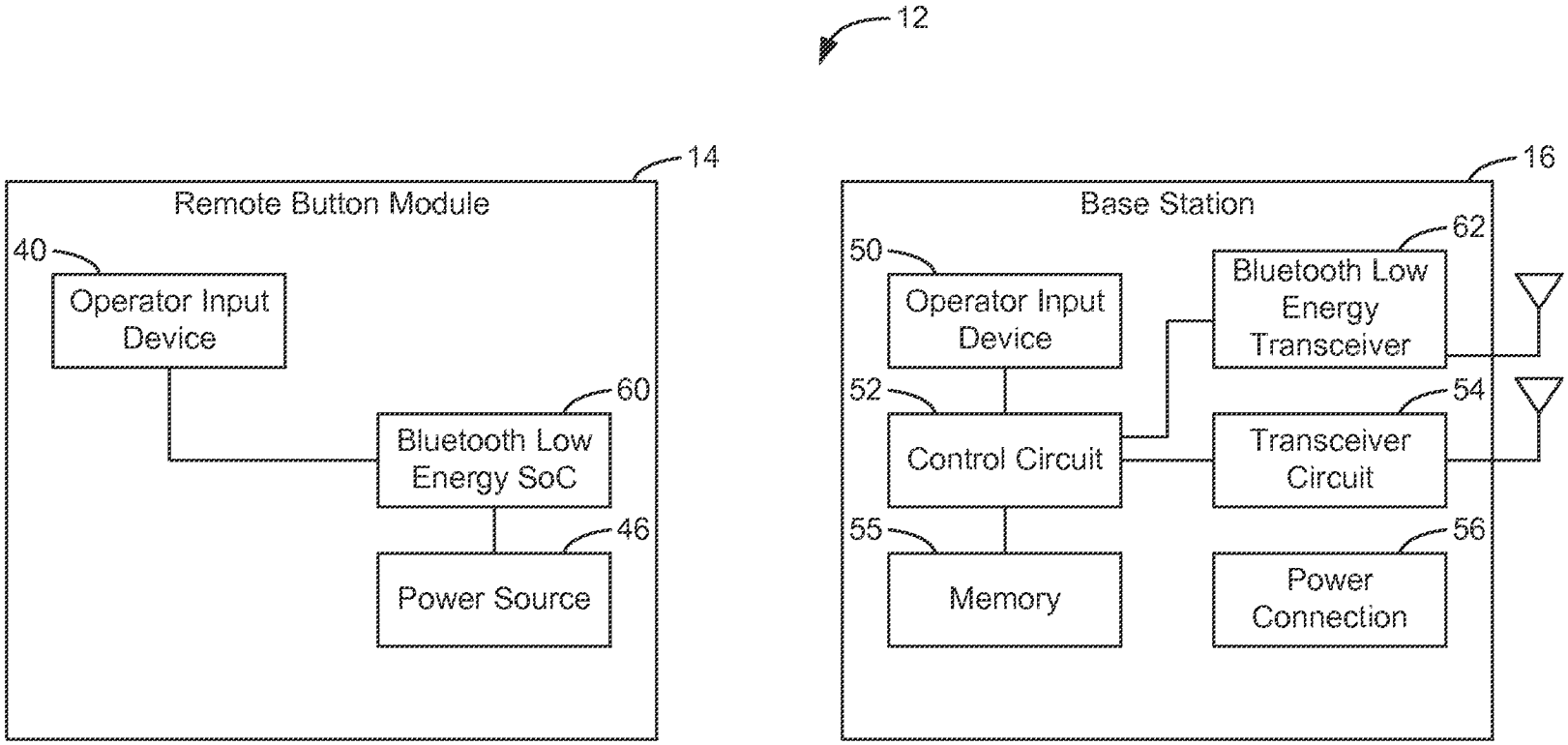
FIG. 4C illustrates an embodiment of the remote button module and the trainable transceiver base station including a Bluetooth low energy system on a chip.

FIG. 4C illustrates an embodiment of the remote button module 14 and the base station 16 including a BLE SoC 60. The remote button module 14 may communication with the base station 16 using the BLE protocol and a BLE SoC 60. In some embodiments, the remote button module 14 and the base station 16 communicate using BLE when in a paired state. The remote button module 14 may include a single SoC implementing the functions of the control circuit and memory discussed above as well as handling inputs from operator input devices 40 and communicating using the BLE protocol. This communication may, as described above, allow the remote button module 14 and the base station 16 to send and receive control signals, inputs, data, and/or other information. The base station 16 includes a BLE transceiver 62 as well in order to allow the base station 16 to communicate with the remote button module 14. The BLE SoC 60, BLE transceiver 62, and BLE protocol may also be used to pair the remote button module 14 and the base station 16. In some embodiments, the BLE SoC 60 may replace the transceiver circuit 44 of the remote button module 14 as illustrated in FIG. 4B. In other embodiments, the BLE SoC 60 may supplement the transceiver 44. In some embodiments, the BLE SoC 60 may replace the transceiver circuit 54 of the base station 16. In such a case, the base station 16 may communicate, using the BLE protocol, with home electronic devices and/or remote devices. In other embodiments, the base station 16 includes both a BLE transceiver 62 and a transceiver circuit 54. In such a case, the base station 16 communicates with the remote button module 14 using the BLE protocol and BLE transceiver 60. The base station 16 may communicate with home electronic devices and/or remote devices using a transceiver circuit 54. The base station 16 may have one antenna coupled to the BLE transceiver 62 and a second antenna coupled to the transceiver circuit 54. Advantageously, this allows the remote button module 14 to communicate with the base station 16 using a low energy protocol to conserve electrical power and reduce the size of the battery needed to support the functions of the remote button module 14. Additionally, the range of the base station 16 is not reduced because it uses the transceiver circuit 54 (e.g., a transceiver broadcasting with greater power and/or range) to communicate with home electronic devices and/or remote devices. In both the remote button module 14 and the base station 16, the BLE SoC 60 may be controlled entirely or in part by the control circuit to which it is coupled. In some embodiments, the first antenna and or the second antenna are one or more of a flexible antenna, hinged antenna, wire antenna, part of the frame of the base station 16 or remote button module 14, loop antenna, or other antenna structure or type.

Figure 4D:
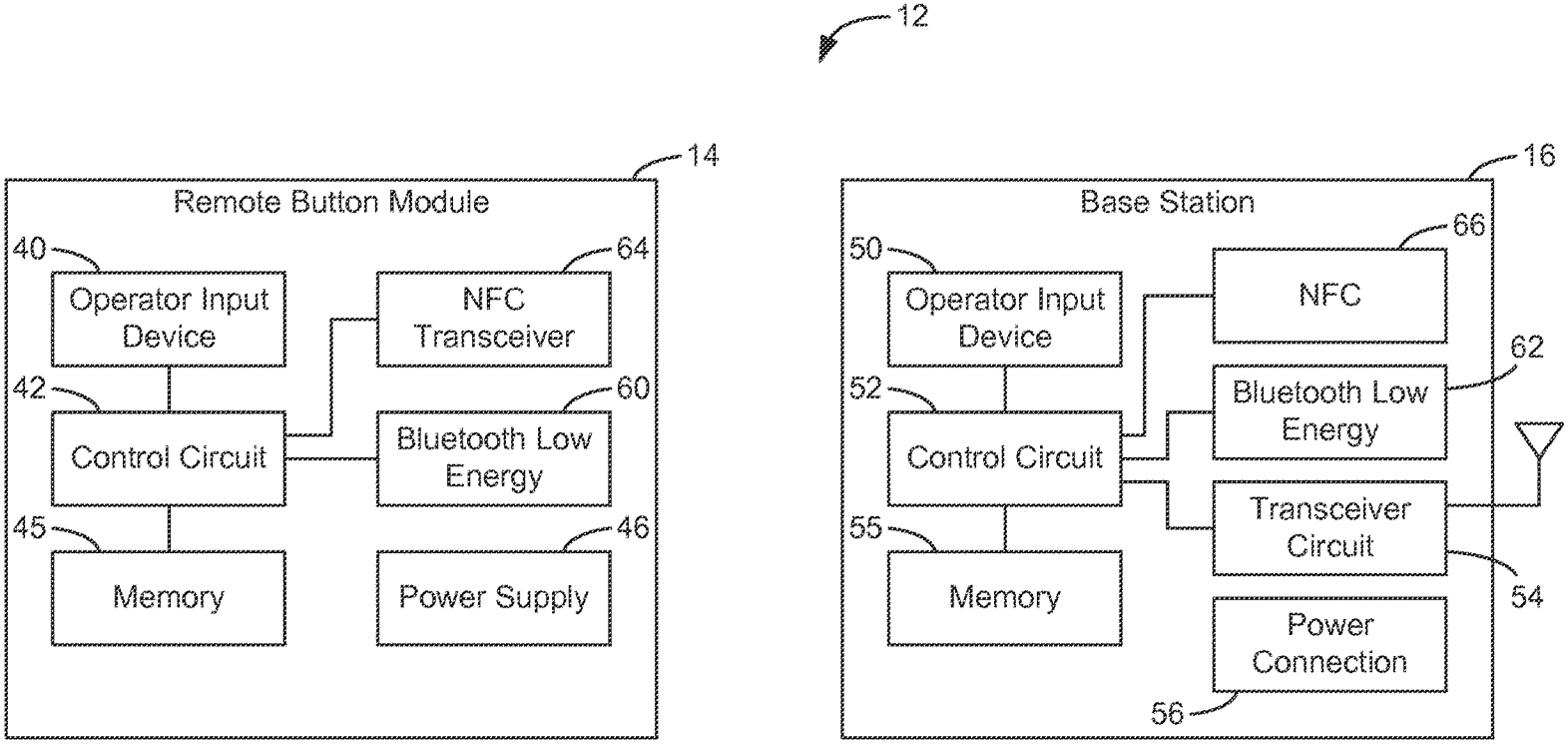
FIG. 4D illustrates and embodiment of the remote button module and the base station including a near field communications system on a chip.

FIG. 4D illustrates and embodiment of the remote button module 14 further including a NFC communications device. The NFC communications device may be an NFC transceiver 64 coupled to the control circuit 42. In other embodiments, the NFC communications device is or forms part of a SoC. The base station 16 may include an NFC transceiver 66. This embodiment retains the advantages discussed with respect to FIG. 4C. Additionally, the remote button module 14 and the base station 16 may communicate using NFC transceivers 64 and 66 and a NFC protocol. For example, the remote button module 14 and the base station 16 may pair using a NFC protocol. In some embodiments, this eliminates the need to exchange pairing passwords while allowing a secured (e.g., encrypted) connection to be established between the remote button module 14 and the base station 16. This may advantageously simplify the pairing process by simply requiring that the remote button module 14 and the base station 16 be in close proximity. Furthermore, the requirement of close proximity (e.g., within the range of the NFC transceivers 64 and 66) may add to the security of the distributed remote system 12. In further embodiments, additional steps may be required to pair the remote button module 14 and the base station 16. For example, an input may be required on the remote button module 14 and/or the base station 16 in order to complete pairing.

Figure 4E:
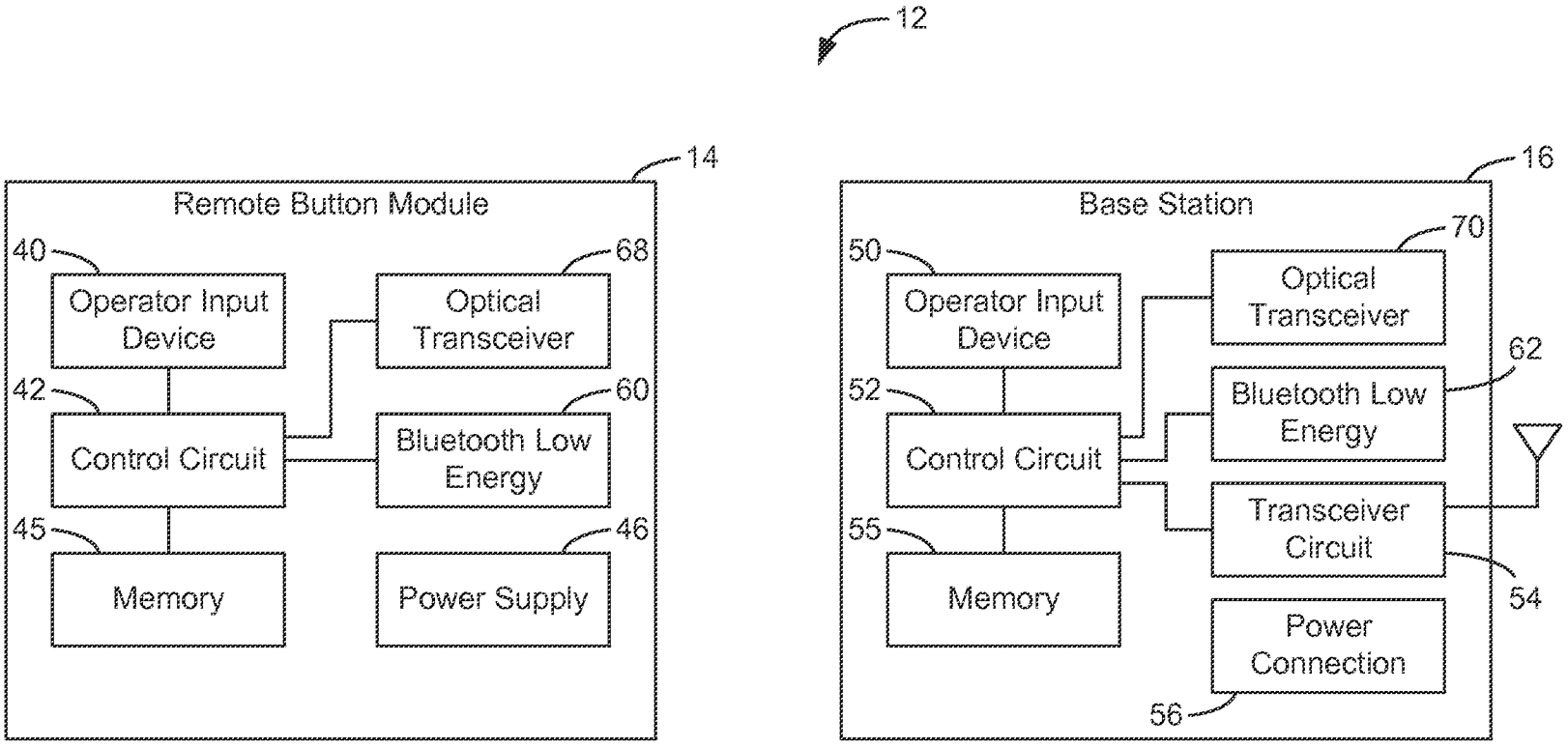
FIG. 4E illustrates an embodiment of the distributed remote system including an optical transceiver in the remote button module and in the base station.

FIG. 4E illustrates an embodiment of the distributed remote system 12 including an optical transceiver 68 in the remote button module 14 and an optical transceiver 70 in the base station 16. The optical transceivers 68 and 70 may be used in the manner described with reference to FIG. 4D and the NFC transceivers 64 and 66. The optical transceivers 68 and 70 may be used to pair the remote button module 14 and the base station 16. In other embodiments, the optical transceivers 68 and 70 may replace the BLE transceivers 60 and 62 for communication between the remote button module 14 and the base station 16. The optical transceivers 68 and 70 may allow for communication between the remote button module 14 and the base station 16. In some embodiments, the optical transceivers 68 and 70 may require a line of sight between the remote button module 14 and the base station 16 in order to allow communication between the two. Advantageously, this may increase the security of the distributed remote system 12 by requiring line of sight between the remote button module 14 and the base station 16.

Figure 4F:
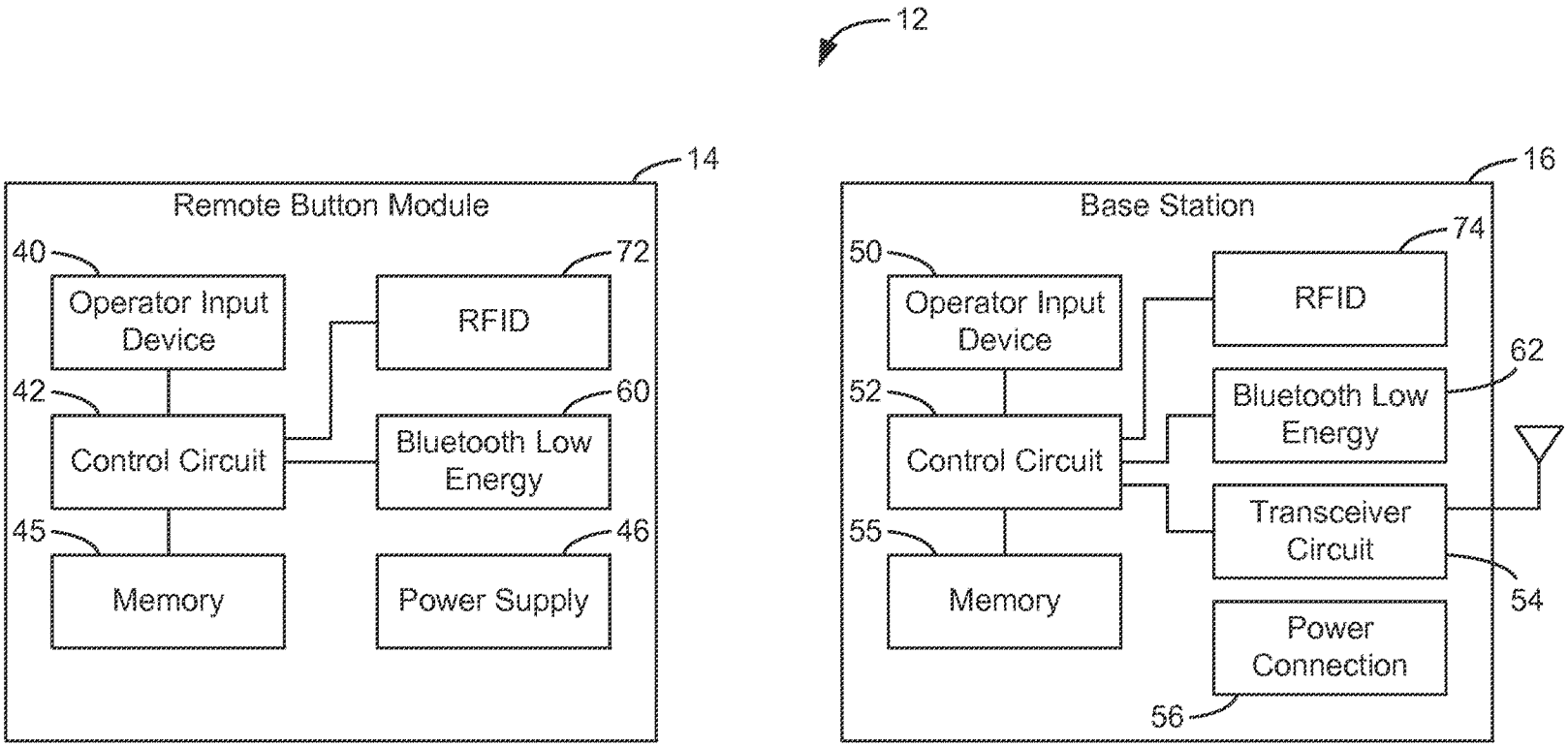
FIG. 4F illustrates an embodiment of the distributed remote system including a radio frequency identification circuit in the remote button module and in the base station.

FIG. 4F illustrates an embodiment of the distributed remote system 12 including a radio frequency identification circuit 72 in the remote button module 14 and a radio frequency identification circuit 74 in the base station 16. The radio frequency identification circuits 72 and 74 may be used in the manner described with reference to FIG. 4D and the NFC transceivers 64 and 66. The radio frequency identification circuits 72 and 74 may be used to pair the remote button module 14 and the base station 16. In other embodiments, the radio frequency identification circuits 72 and 74 may replace the BLE transceivers 60 and 62 for communication between the remote button module 14 and the base station 16. The radio frequency identification circuits 72 and 74 may allow for communication between the remote button module 14 and the base station 16. In some embodiments, the radio frequency identification circuits 72 and 74 may require close proximity between the remote button module 14 and the base station 16 in order to allow communication between the two. Advantageously, this may increase the security of the distributed remote system 12 by requiring close proximity between the remote button module 14 and the base station 16. In some embodiments, the remote button module 14 and/or the base station 16 may include one or more of the above communication hardware components described with reference to FIGS. 4A-F.

Figure 5A:
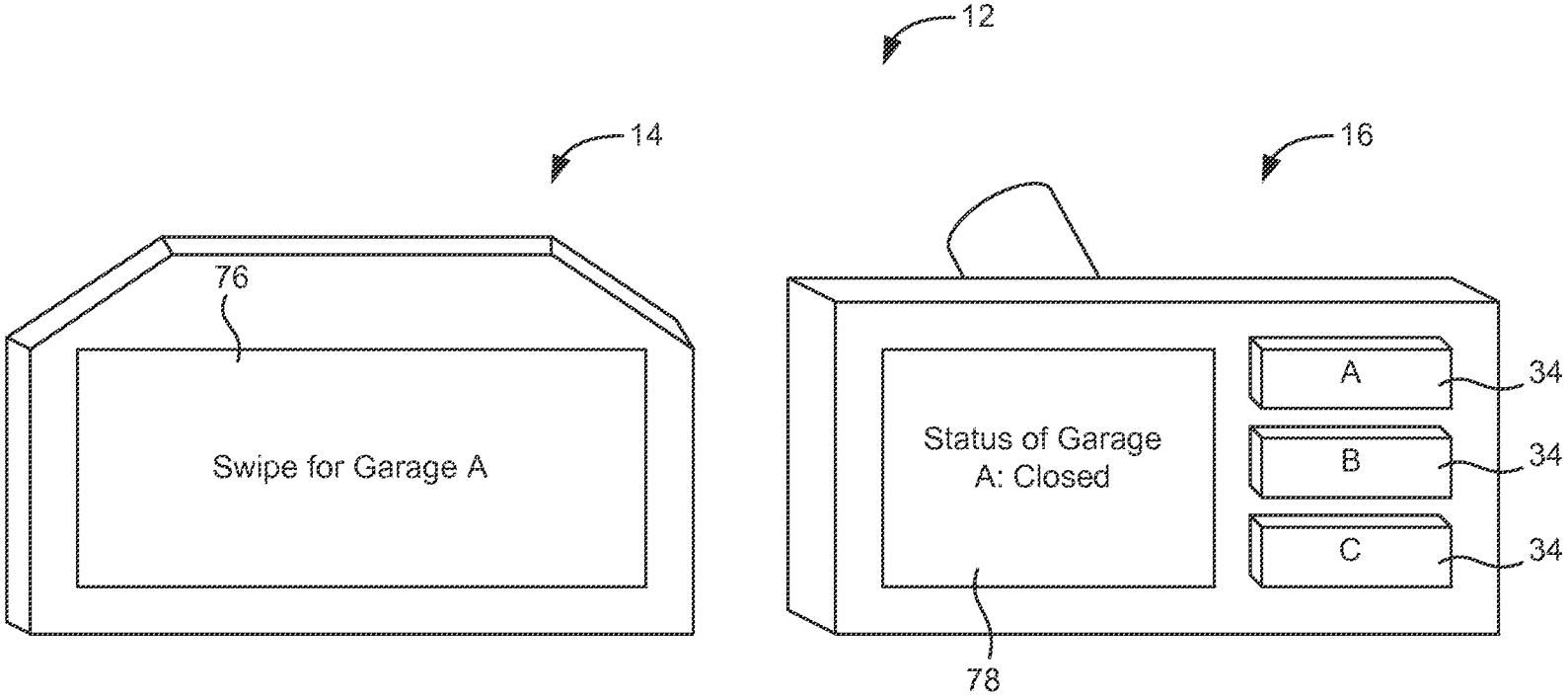
FIG. 5A illustrates an embodiment of the distributed remote system in which the remote button module and/or the base station include a touchscreen.

FIG. 5A illustrates an embodiment of the distributed remote system 12 in which the remote button module 14 and/or the base station 16 include a touchscreen. The remote button module 14 may include a touchscreen 76 for receiving user inputs and/or displaying output to a user. In some embodiments, the remote button module 14 has a single touchscreen input device 76 and no other input devices. In other embodiments, multiple touchscreens and/or other input devices may be included in the remote button module 14. The base station 16 may include a touchscreen 78 for receiving user inputs and/or displaying output to a user. In some embodiments, the base station 16 has a single touchscreen input device 78 and no other input devices. In other embodiments, multiple touchscreens and/or other input devices may be included in the base station 16. For example, the base station 16 may include three buttons 34 and a touchscreen 78. The touchscreens 76 and 78 may be any display configured to receiver user inputs through touch. For example, the touchscreens 76 and 78 may be a projected capacitive touchscreen, resistive touchscreen, or other touchscreen display. A touchscreen and/or other display (LCD, LED, plasma, etc.) on the remote button module 14 and/or base station 16 may display information such as pairing codes, home electronic device and/or remote device status (e.g., lights are on, garage door is open, etc.), the last command given to a remote device or home electronic device, the time, weather information, application information from a mobile device connected to the distributed remote system 12, or other information. In some embodiments, the buttons 34 of the base station 16 may correspond to different devices. For example, a first button 34 may send a control signal to device A, a second button 34 may send a control signal to device B, and a third button 34 may send a control signal to device C. In other embodiments, the buttons 34 of the base station 16 may correspond to other functions such as entering information, navigating displayed information, or providing other user inputs.

Figure 5B:
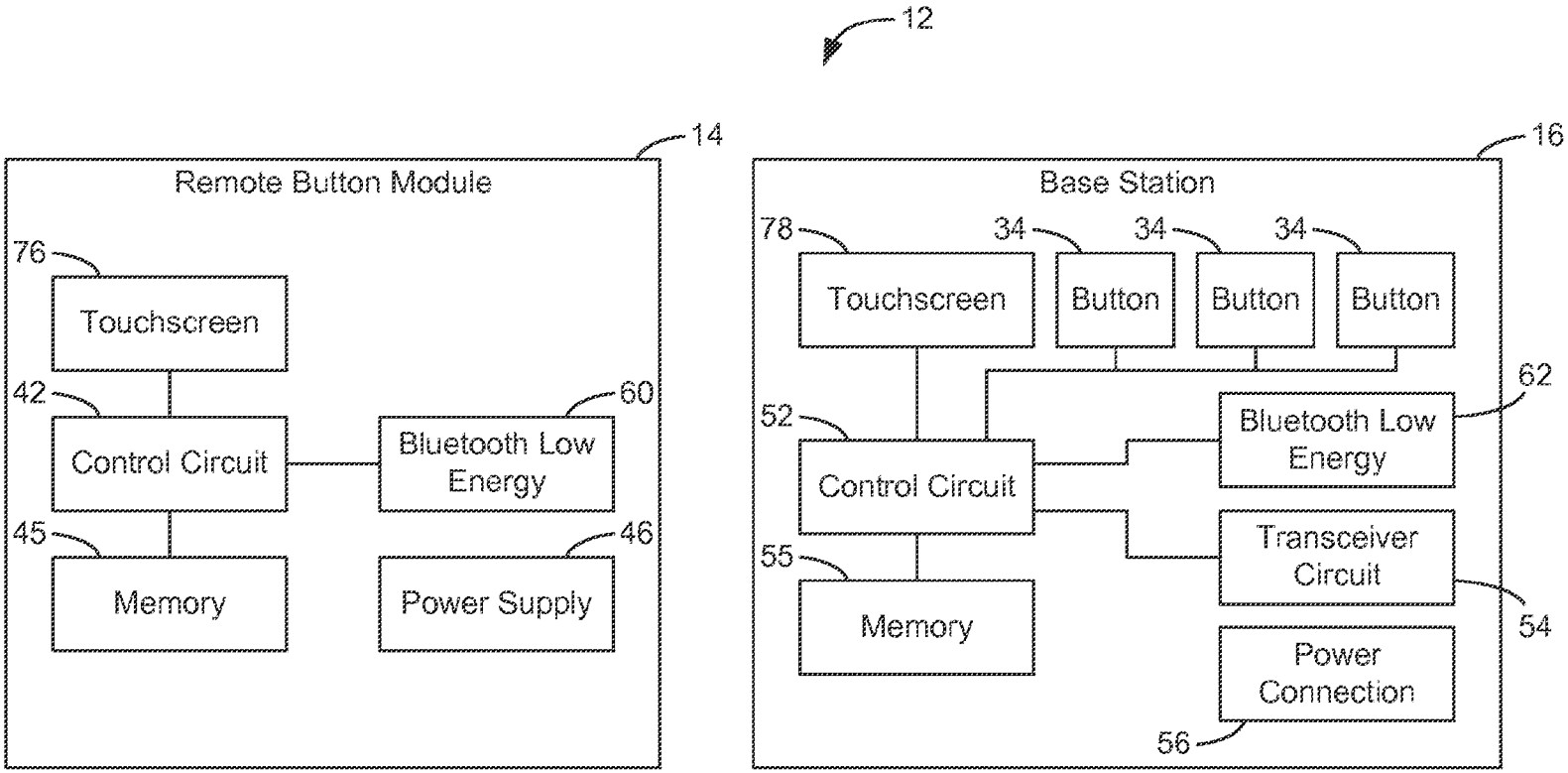
FIG. 5B illustrates a block diagram of the hardware corresponding to one embodiment of the base station and remote button module.

FIG. 5B illustrates a block diagram of the hardware corresponding to the embodiment illustrated in FIG. 5A. The touchscreens included in the remote button module 14 and the base station 16 may be coupled to the corresponding control circuits. In some embodiments, the touchscreen may include a controller and other hardware components such as processors, ICs, ASIC, memory, etc. In other embodiments, the control circuit may provide controller functionality for the touchscreen. For example, the control circuit may generate bitmaps and/or other graphic data for display by the touchscreen, handle user inputs, etc.

Figure 6A:
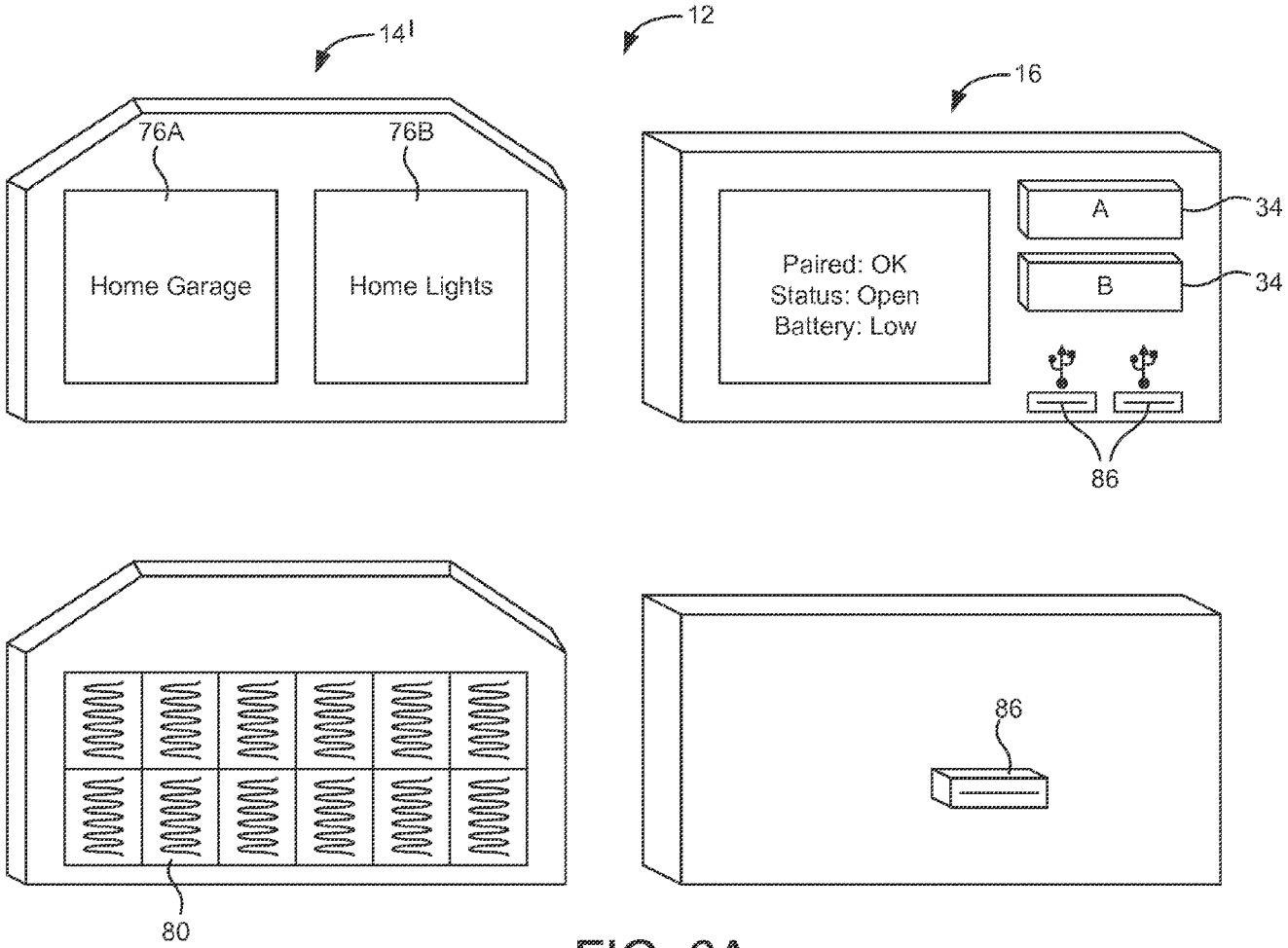
FIG. 6A illustrates an embodiment of the remote button module having two touchscreen displays and an embodiment of the base station having universal serial bus connection.
Figure 6B:
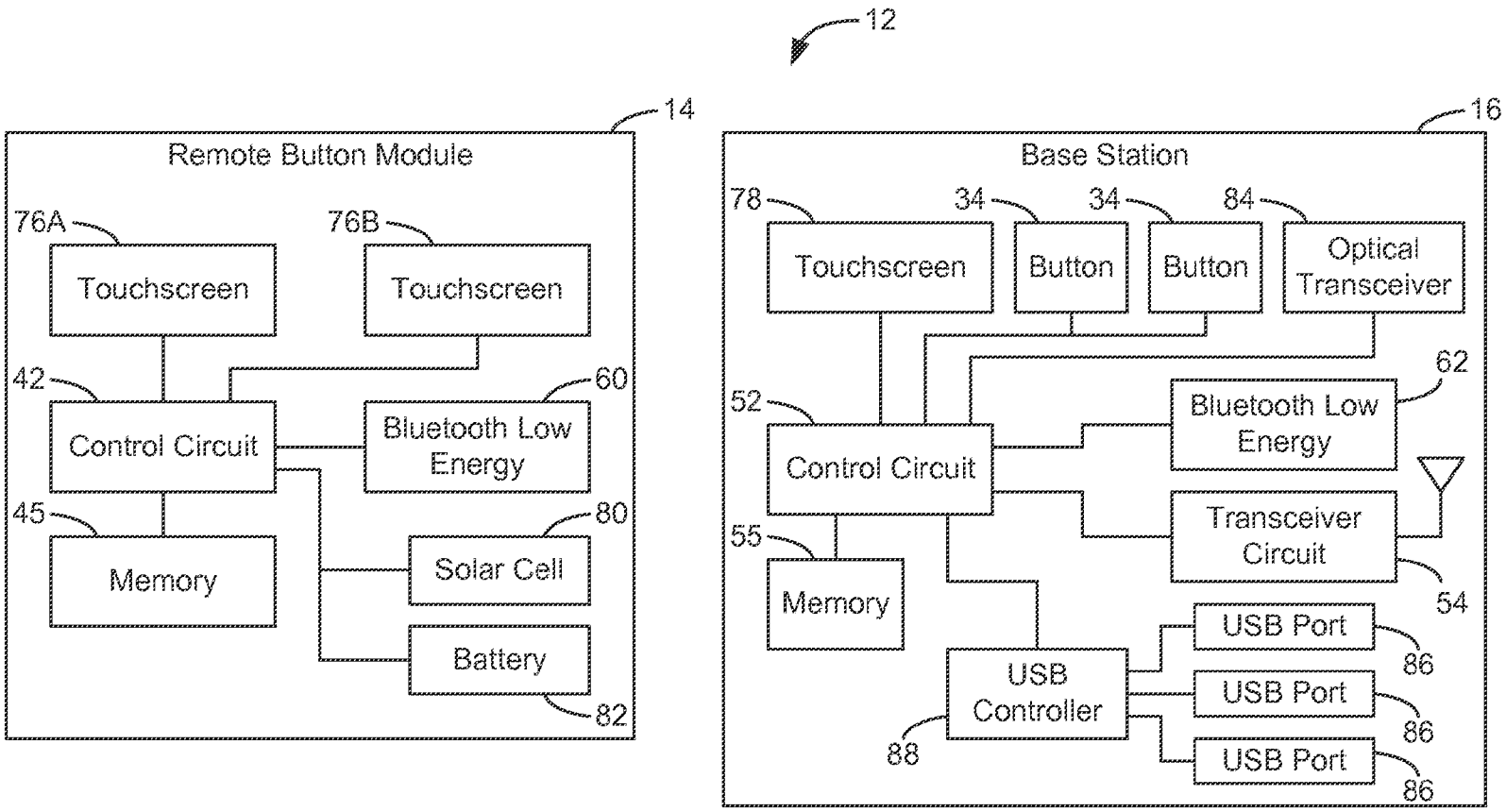
FIG. 6B illustrates a block diagram of the hardware corresponding to one embodiment of the base station and remote button module.

FIG. 6A illustrates an embodiment of the remote button module 14 having two touchscreen displays 76A and 76B. In other embodiments, other combinations of displays and/or user input devices discussed herein are possible. In some embodiments, the remote button module 14 may include one or more solar cells 80 as depicted in FIG. 6A. With reference to FIG. 6B, a solar cell 80 may be connected to one or more of the control circuit 42 and a battery 82. The solar cell 80 may provide a supplemental source of power for the remote button module 14. In some embodiments, the solar cell 80 may directly power components of the remote button module 14. In other embodiments, the solar cell 80 may charge the battery 82 of the remote button module 14. The solar cell 80 and/or the battery 82 may be controlled by the control circuit 42. The solar cell 80 may be connected directly to one or more components or indirectly through the battery 82. In some embodiments, other power sources may supplement or replace the battery 82. For example, the solar cell 80 may first charge a capacitor which provides power to components of the remote button module 14 and/or a battery 82. The solar cell 80 may be placed on the backside of the remote button module 14 such that it receives light through the windshield of a vehicle. Touchscreens 76A and 76B of the remote button module 14 may correspond to different devices controlled by the base station 16. In some embodiments, a user may provide a custom label for the devices which are controlled by the base station 16 and the remote button module 14. The label or labels may be displayed on one or more touchscreens of the remote button module 14. The customization may be performed using the base station 16. The base station 16 may provide information regarding whether the remote button module 14 is paired to the base station 16, the status of a device controlled by the distributed remote system 12 (e.g., that a garage door is open), the power remaining in a battery (e.g., the battery 82 in the remote button module 14), or other information related to the distributed remote system 12 or the devices controlled by the distributed remote system 12.

In some embodiments, the base station 16 may communicate with the remote button module 14 using an optical transceiver 84. The signals sent by the optical transceiver 84 of the base station 16 may be received by the solar cell 80 of the remote button module 14. For example, the base station 16 may send pairing information using the optical transceiver 84 to the solar cell 80 of the remote button module 14. The signal may be interpreted using the control circuit 52 coupled to the solar cell 80. Changes in voltage corresponding to the intensity of the light produced by the optical transceiver 84 may be converted to data or information by the control circuit 52 coupled to the solar cell 80.

With reference to FIG. 6A, some embodiments of the base station 16 may include USB ports 86. In some embodiments, the base station 16 connects to the vehicle 10 via a USB port of the vehicle. The base station 16 may include pass through USB ports 86 on the face of the base station 16. Advantageously, this allows the base station 16 to draw electrical power from the vehicle and allows a user to have access to the vehicle systems through the pass through USB ports 86 on the base station 16. In some embodiments, the pass through USB ports 86 of the base station 16 may be configured to charge user devices connected via the pass through USB ports 86. The base station 16 may include a USB port 86 on the rear of the base station 16 in order to connect to the vehicle USB port. In some embodiments, the base station 16 may connect to the vehicle using a flexible USB cord. In other embodiments, a positionable (e.g., with hinges) USB connector connects the base station 16 to the vehicle. In some embodiments, the base station 16 may also include a 12 volt power port. In other embodiments (e.g., in which the base station 16 connects to 12 volt power port), the base station 16 may include a pass through 12 volt power port.

With reference to FIG. 6B, the base station 16 may include a USB controller circuit 88 to manage USB connections provided by the base station 16 and/or the USB connection between the base station 16 and the vehicle or the base station 16 and other devices. In some embodiments, the functions of the USB controller 88 may be performed by the control circuit 52.

Figure 7A:
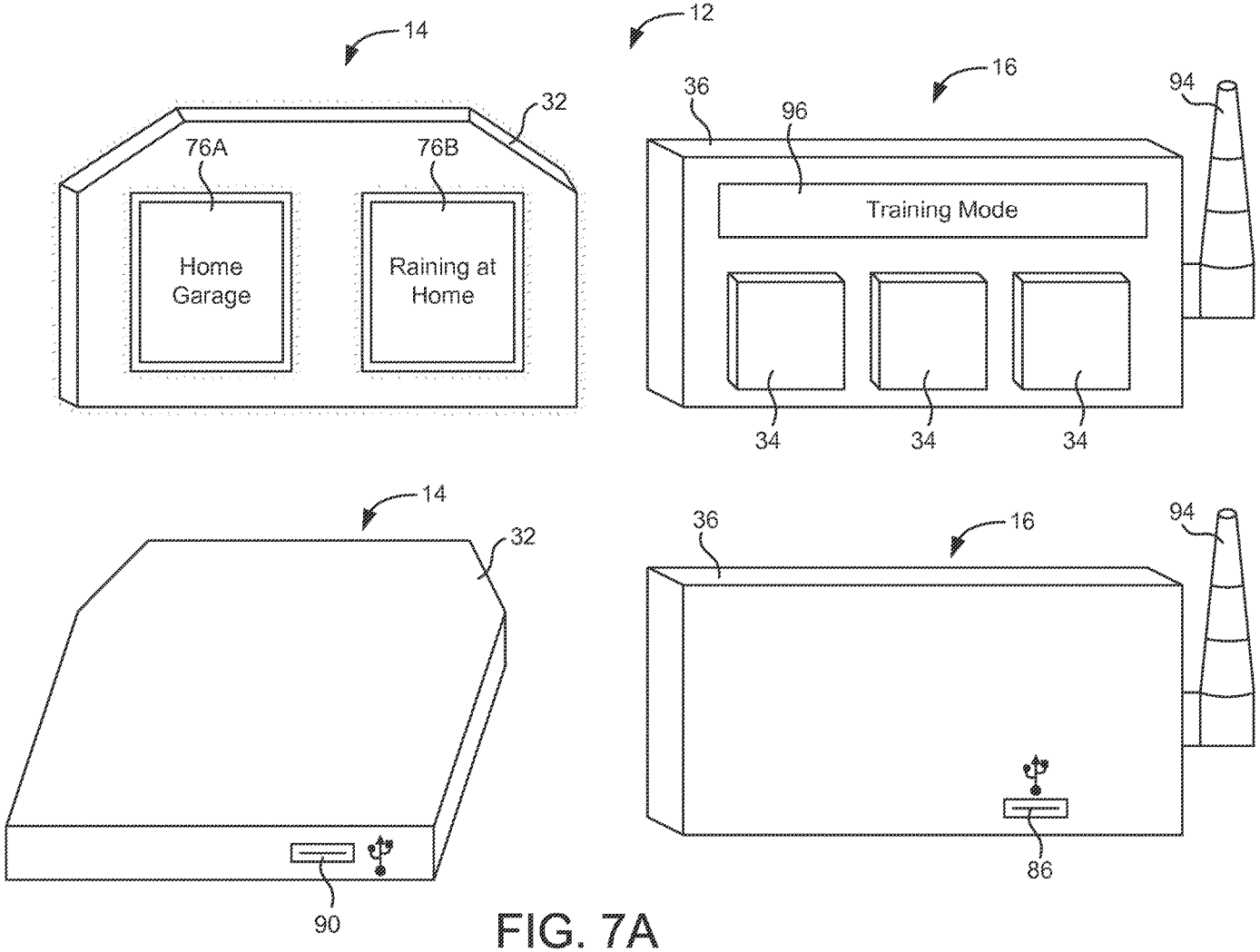
FIG. 7A illustrates an embodiment of the remote button module having backlighting and an embodiment of the base station having an external antenna.

FIG. 7A illustrates an embodiment of the remote button module 14 including lighting devices. The remote button module 14 may include lighting devices which illuminate all or part of the remote button module 14. For example, lighting devices may illuminate the operator input devices (e.g., buttons 30, touchscreens 76A and 76B, etc.) of the remote button module 14. In other embodiments, the bezel and/or housing 32 of the remote button module 14 may be illuminated. In some embodiments, the remote button module 14 may be backlit (e.g., the entirety of or a portion of remote button module 14 backlit). In further embodiments, illumination may be backlighting of operator input devices of the remote button module 14. Lighting devices may include luminescent material, LEDs, display screens, etc. For example, a glow ring may be included on the remote button module 14. Luminescent material may be included in, on, or make up part of or the entirety of the bezel and/or housing 32 of the remote button module 14. In some embodiments, back lighting (e.g., by one or more LEDs) may be activated when a proximity sensor detects a user. For example, when a user moves his or her hand into a detection zone defined by the specifications of the proximity sensor, the proximity sensor detects the user and the control circuit 42 activates backlighting of the operator input device. In further embodiments, backlighting may be activated upon receiving a user input (e.g., LED is illuminated, touchscreen displays an image, etc.). This may provide visual feedback to a user. In additional embodiments, the base station 16 includes backlighting of the type discussed herein.

In some embodiments, the remote button module 14 may include a USB port 90 as illustrated in FIG. 7A. The USB port 90 (e.g., micro USB port) may be located on the side, bottom, rear, front, or other face of the remote button module 14. In some embodiments, the remote button module 14 may be recharged from a power source using the USB port 90. In other embodiments, the remote button module 14 may receive or output information using the USB port 90.

Figure 7B:
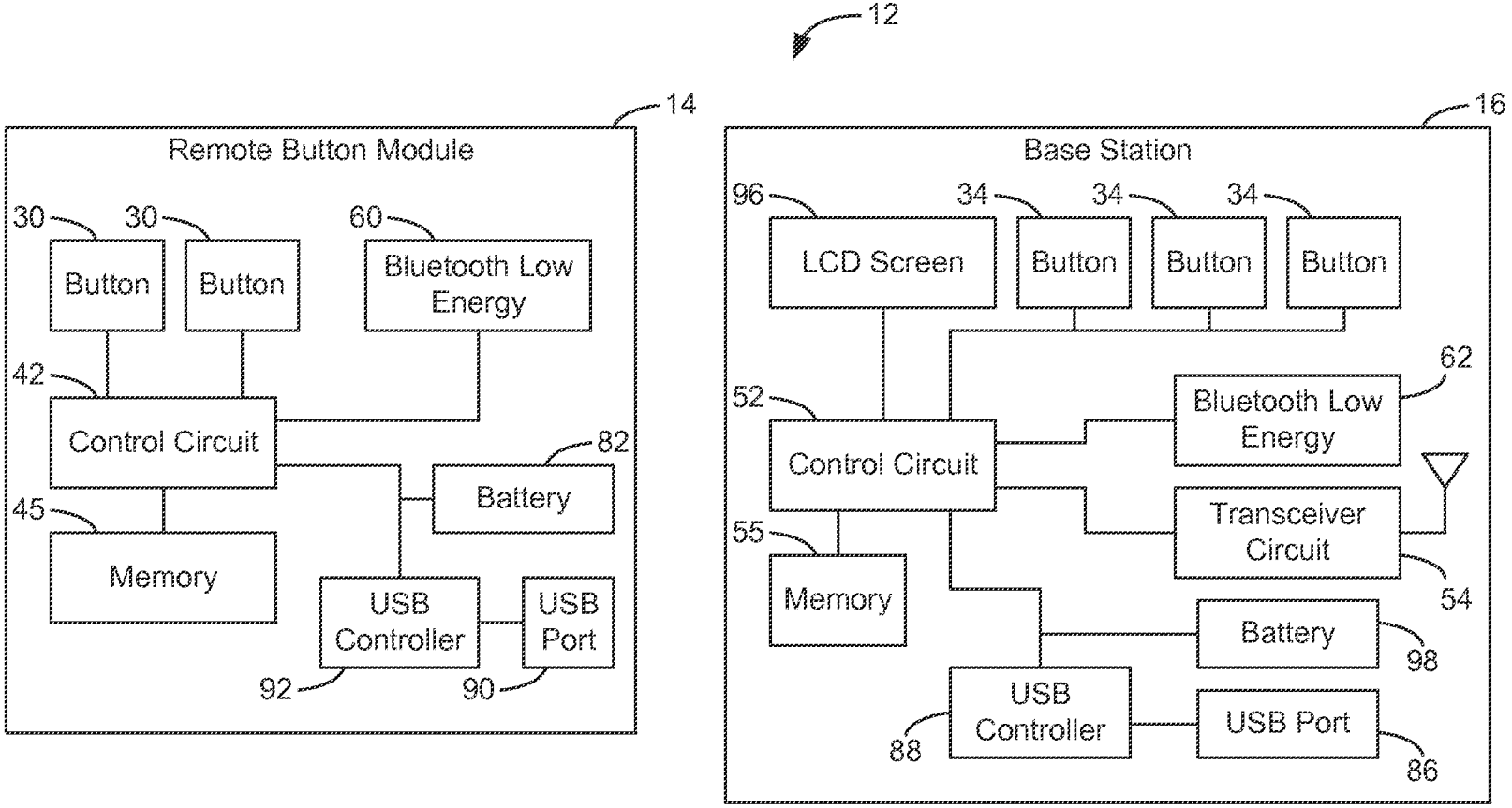
FIG. 7B illustrates a block diagram of the hardware corresponding to one embodiment of the trainable transceiver base station and remote user interface module.

FIG. 7B illustrates the remote button module 14, according to one embodiment, including a USB controller 92. As previously discussed, the USB controller 92 may control the USB port 90 and/or facilitate the functions described above.

Referring again to FIG. 7A, in some embodiments, the base station 16 may have an external or partially external antenna 94. The antenna 94 may be a component of the transceiver circuit 54 or be connected to the transceiver circuit 54. In some embodiments, the position of the external antenna 94 may be adjustable by a user. In further embodiments, the external antenna 94 may be a wire antenna. In other embodiments, the external antenna 94 may be located remote to the base station 16 and connected thereto by a wire or other electrical connection or a wireless connection. In other embodiments, the base station 16 may include an internal antenna. The internal antenna may be located entirely or partially within the housing of the base station 16. In some embodiments, the housing 36 or a portion of the housing of the base station 16 may function as an antenna. In other embodiments, the antenna 94 may be hinged such that it may be positioned and/or hidden, may be removable (e.g., unscrew from the base station 16), may be flexible, may be a loop antenna, and/or may be another type or structure.

In some embodiments, the base station 16 may include a display 96 (e.g., LCD, LED, plasma, e-ink, or other display) as well as other operator input devices (e.g., buttons 34). The display 96 may be used to display information to a user. For example, the display 96 may be used to display a pairing code, home electronic device or remote device status or information, the last command transmitted by the base station 16, whether the base station 16 is in training mode, or other information related to the distributed remote system 12 or a device controlled by the system.

The remote button module 14 may also display information or data received from the base station 16. In some embodiments, the base station 16 may forward data to the remote button module 14 that the base station 16 has received from a home electronic device and/or remote device. For example, the base station 16 may receive data from a weather device that it is raining at the user's home. The base station 16 may communicate this data to the remote button module 14 which may display it to the user on a display and/or touchscreen.

In some embodiments, the base station 16 may include a rechargeable battery 98. The rechargeable battery 98 may be recharged using a USB port 86 of the base station 16 and a connection to a power source. In other embodiments, the remote button module 14 and the base station 16 may be paired by connecting a USB port 90 on the remote button module 14 to a USB port 86 on the base station 16.

Referring now to FIG. 7B, the base station 16 may include a USB controller 92. The USB controller 92 may have the same functions previously described. In some embodiments, the USB controller 92 and/or the control circuit 42 may allow the remote button module 14 and the base station 16 to be paired over a USB connection. In embodiments of the base station 16 including a display 96 (e.g., LCD screen), the LCD screen is connected to the control circuit 52. The control circuit 52 and/or the LCD screen may function as a controller for the LCD screen. A battery 98 may be connected to the USB controller 88 in order to recharged through the USB port 86. The battery 98 may be connected to the control circuit 52 and or other components directly or indirectly. The battery 98 provides electrical power to components of the base station 16.

Figure 8A:
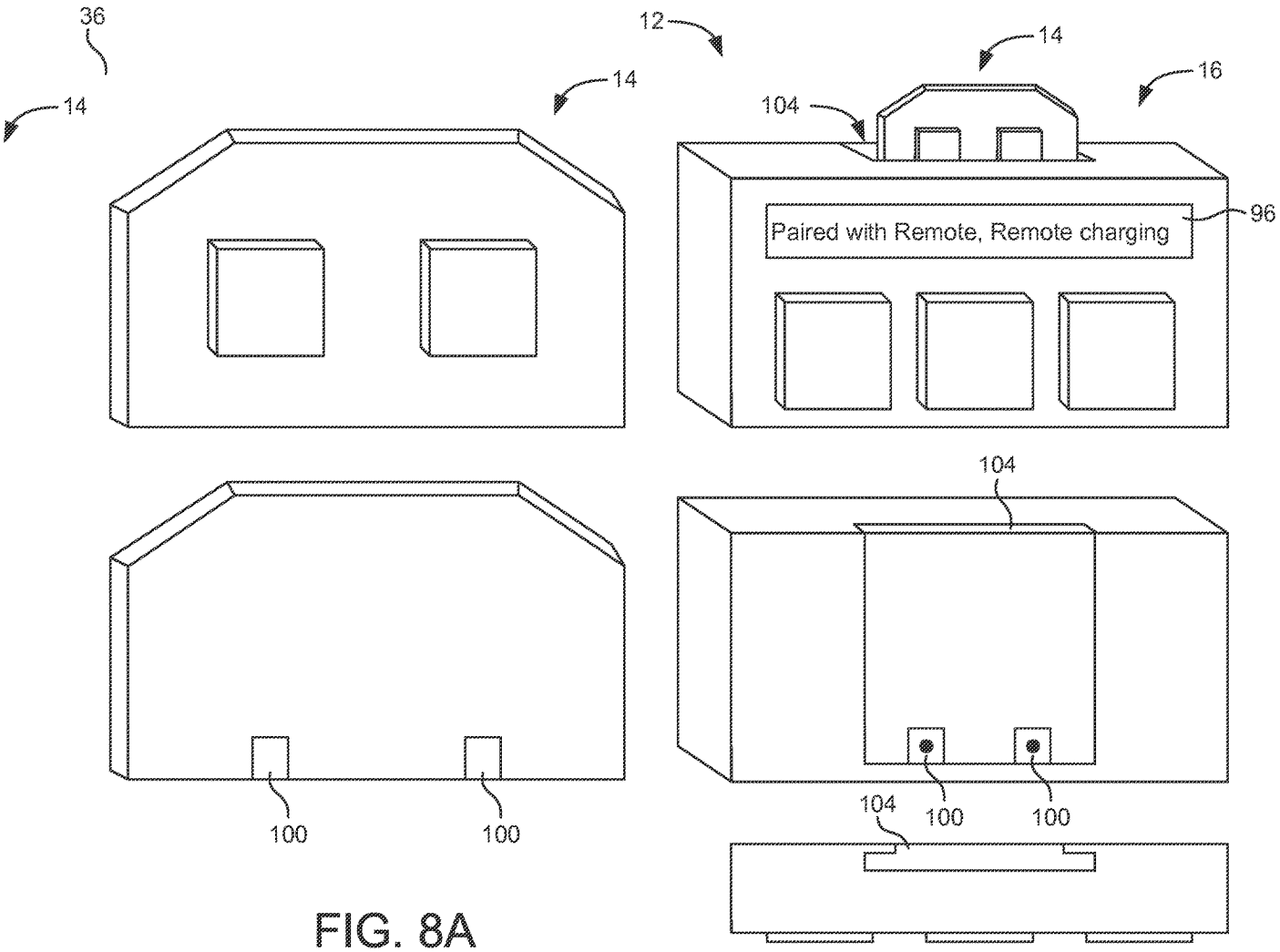
FIG. 8A illustrates an embodiment of the remote button module and the base station which include contacts.

FIG. 8A illustrates an embodiment of the remote button module 14 and the base station 16 which include contacts. In some embodiments, the contacts 100 of the remote button module 14 are located on the rear of the remote button module 14 and the contacts 102 of the base station 16 are located on the rear of the base station 16. Two or more contacts may be included on the remote button module 14 and/or the base station 16. In one embodiment, the remote button module 14 and the base station 16 are brought into electrical connection through contact between the contacts 100 of the remote button module 14 and the contacts 102 of the base station 16. In one embodiment, the remote button module 14 is inserted into a slot or groove 104 of the base station 16 which holds the remote button module 14. The contacts 100 and 102 and or the configuration of the slot or groove 104 may hold the remote button module 14 in place until a user removes the remote button module 14. In other embodiments, the remote button module 14 may snap into the base station 16 to be brought into electrical contact with the base station 16 through the contacts 100 and 102. A user may remove the remote button module 14 by unsnapping the remote button module 14 from the base station 16. In some embodiments, the snapping functionality is achieved by having a tab, overhang, etc. which plastically deforms. The remote button module 14 may be inserted by deforming the securing feature which returns to its original shape and secures the remote button module 14 once it has cleared the securing feature.

In some embodiments, the contacts 100 and 102 allow for the remote button module 14 to be recharged using the connection to the base station 16 provided by the contacts. In other embodiments, the contacts 100 and 102 allow data transfer between the remote button module 14 and the base station 16. For example, the connection between the contacts 100 of the remote button module 14 and the contacts 102 of the base station 16 may allow the remote button module 14 to be paired with the base station 16. Advantageously, this provides security to the distributed remote system 12 because the remote button module 14 and the base station 16 may be physically paired in order to be wirelessly paired. A user would have to have physical access to both components of the distributed remote system 12. In some embodiments, a display screen 96 of the base station 16 may display information while the remote button module 14 is in communication with the base station 16 such as whether the battery 82 of the remote button module 14 is charging, the remaining battery power of the remote button module 14, whether the remote button and the base station 16 are paired, or other information about the distributed remote system 12.

Figure 8B:
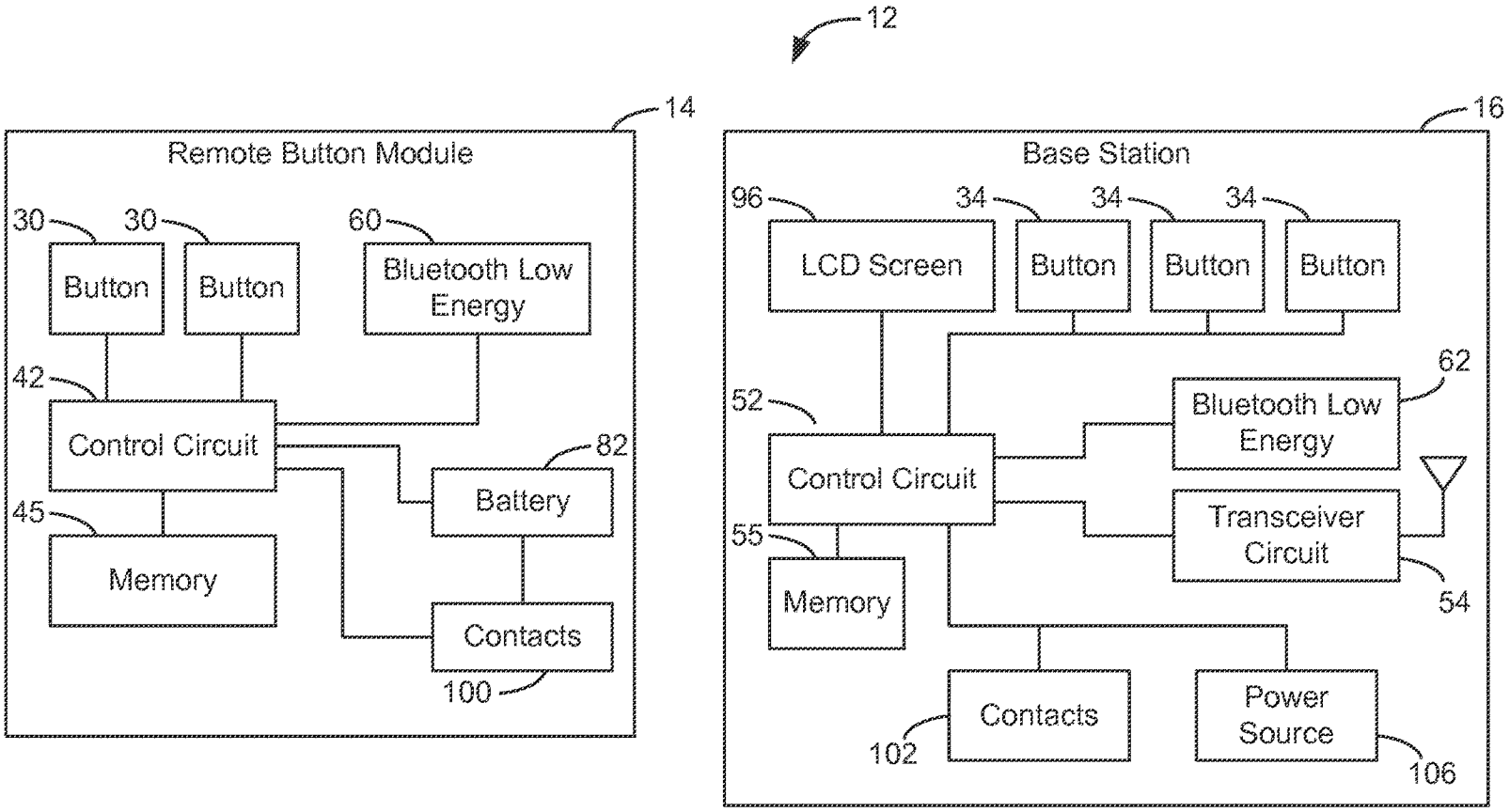
FIG. 8B illustrates a block diagram of the hardware corresponding to one embodiment of the base station and remote button module.

Referring now to FIG. 8B, the contacts 100 of the remote button module 14 and/or the base station 16 may be connected to the control circuit 42 and or the battery 82. In some embodiments, one or more contacts 100 are connected to the battery 82 while a different one or more contacts 100 are connected to the control circuit 42. The control circuit 42 may allow for communication (e.g., data transfer) between the contacts 100 of the remote button module 14 and the contacts 102 of the base station 16. The contacts 100 connected with the battery 82 of the remote button module 14 may allow the battery 82 of the remote button module 14 to be recharged using an electrical connection to the contacts 102 of the base station 16. The contacts 102 of the base station 16 may in turn be connected to a power source 106 (e.g., 12 volt power plug).

Figure 8C:
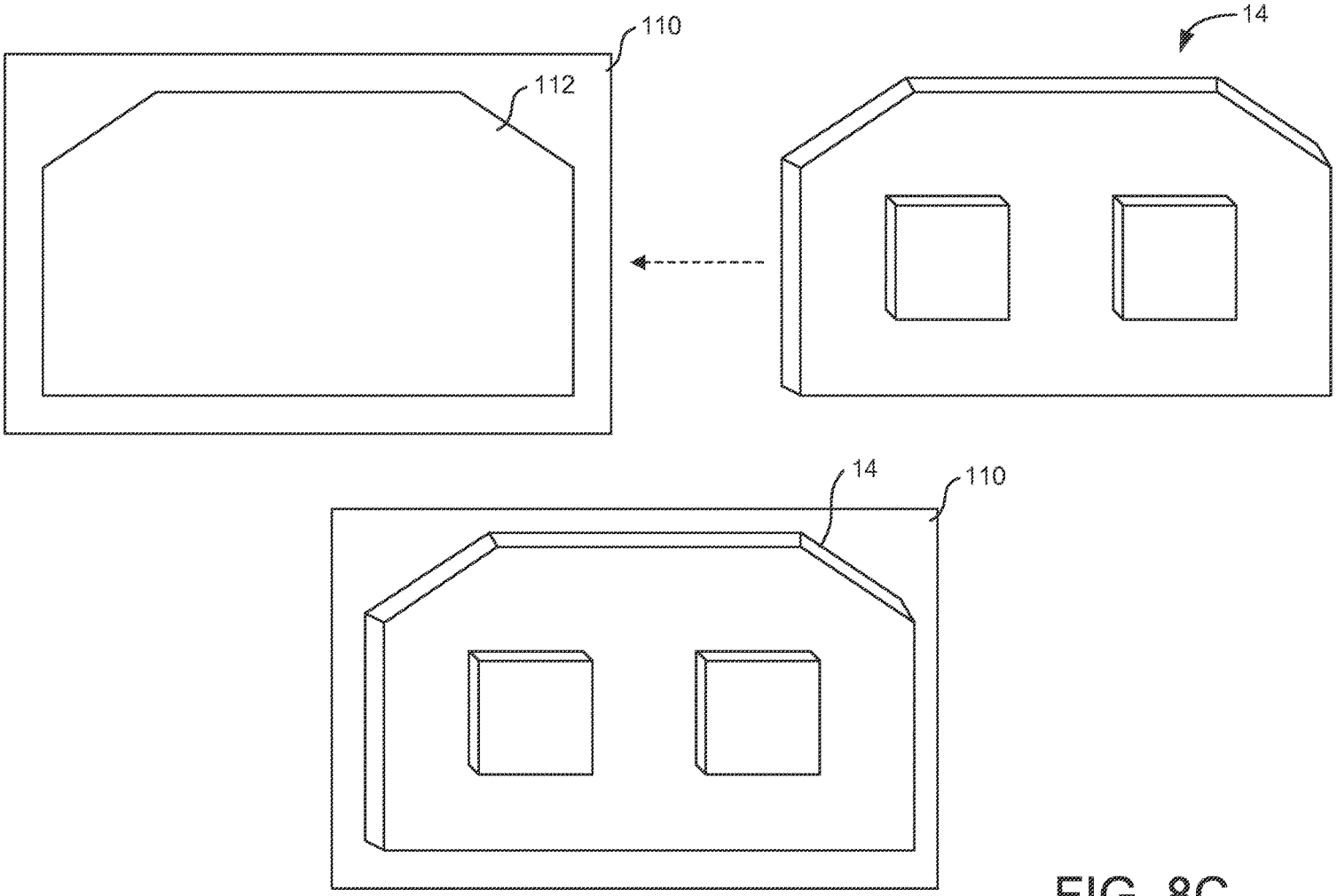
FIG. 8C illustrates one embodiment of a carrier for the remote user interface module.

FIG. 8C illustrates one embodiment of a carrier 110 for the remote button module 14. The carrier 110 may hold or otherwise secure the remote button module 14. In one embodiment, the carrier 110 is configured to allow a user to snap the remote button module 14 into the carrier 110. In some embodiments, the carrier 110 is configured as previously discussed to allow a user to snap the remote button module 14 into the carrier 110. Similarly, a user may remove the remote button module (e.g., to be recharged, paired, etc.) by unsnapping the remote button module 14 from the carrier 110. The carrier 110 may include a window 112 so as to allow a user access to the remote button module 14 including features or components such as operator input devices (touchscreens, buttons, etc.) and/or output devices (e.g., speakers, backlighting, etc.). The carrier 110 may be attached to the vehicle 10 using the techniques previously described (e.g., PSA, foam tape, etc.). Advantageously, the carrier 110 may be attached to the vehicle such that the carrier 110 then allows the remote button module 14 to be removed and inserted and thereby attached to the vehicle 10 through the carrier 110 without having to attach the remote 14 using an adhesive or similar attachment device. The remote button module 14 is easily attached and removed from the vehicle 10 using the carrier 110 while the carrier 110 remains in place. In some embodiments, the carrier 110 may be shaped and/or colored so as to mimic the interior style of a vehicle. In further embodiments, the carrier 110 may be configured to have a bezel attached (e.g., snapped) to the carrier. The bezel may mimic the interior of a particular vehicle.

Figure 8D:
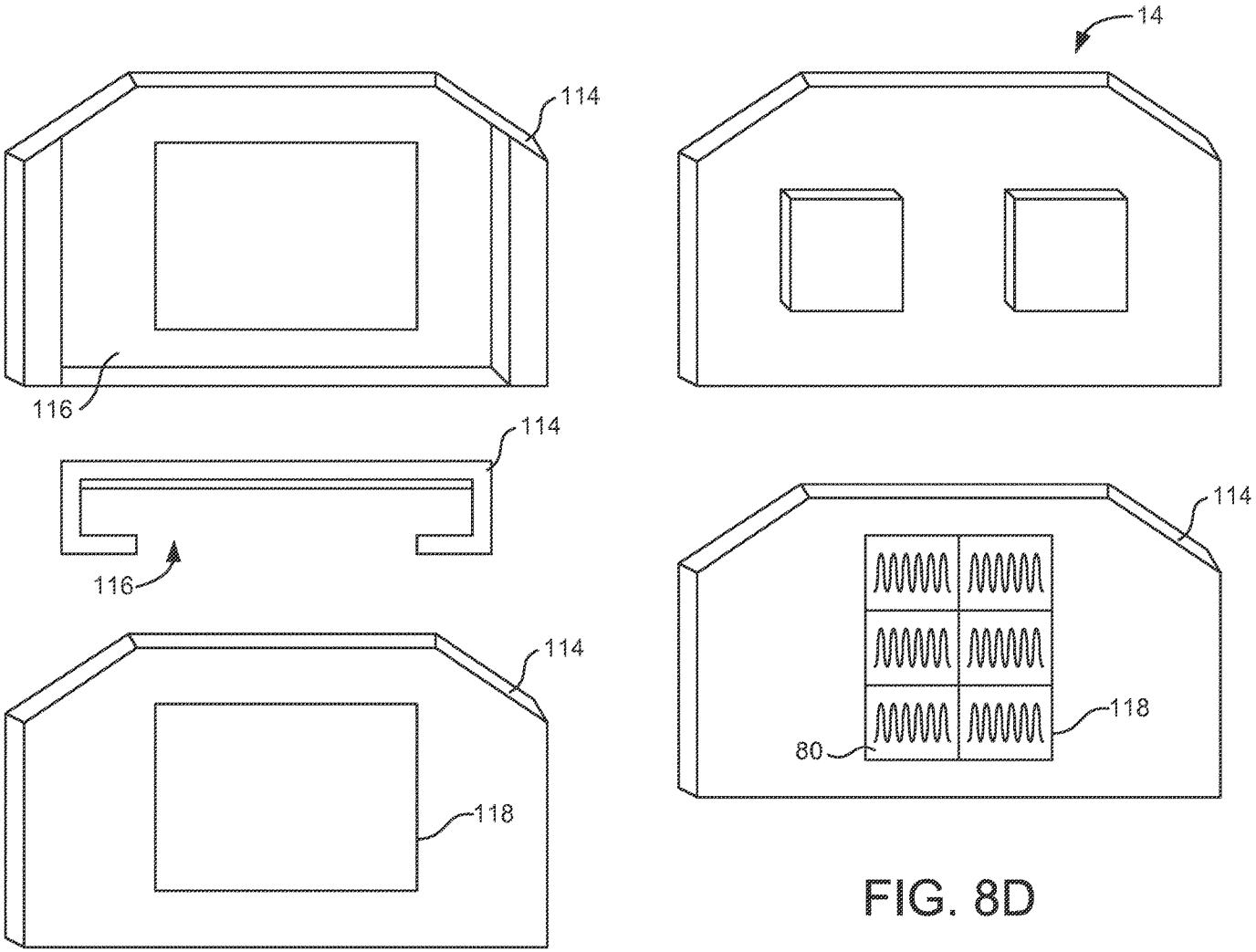
FIG. 8D illustrates an alternative exemplary embodiment of a carrier.

FIG. 8D illustrates an alternative embodiment of a carrier 114. The carrier 114 may include a slot or groove 116 for receiving the remote button module 14. For example, a user may slide the remote button module 14 into the carrier 114 from the top of the carrier 114. The carrier 114 may secure the remote button module 14 using an interference fit with the housing of the remote button module 14. In other embodiments, the contacts of the remote button module 14 or another feature (e.g., a protrusion of the housing) may secure the remote button module 14 in the carrier 114. In some embodiments, the carrier 114 may include a window 118 (e.g., Plexiglas, transparent plastic, etc.) or a cutout which allows a solar cell 80 of the remote button module 14 to receive light.

In some embodiments, the attachment mechanism which allows the remote button module 14 to be attached to the carrier 114 is the same mechanism which allows the remote button module 14 to be attached to the base station 16. For example, the base station 16 includes a slot 104 to receive the remote button module 14, and the carrier 114 includes a slot 116 to receive the remote button module 14.

Figure 9:
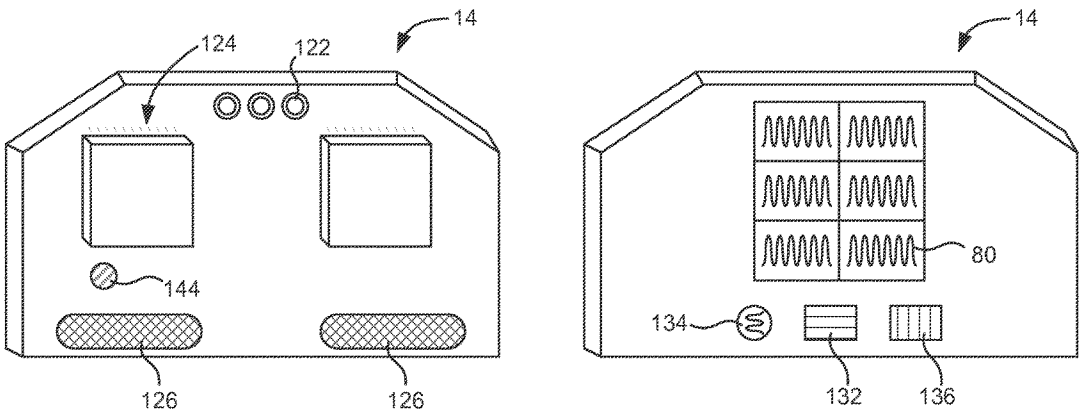
FIG. 9 illustrates an embodiment of the remote button module which includes additional components
Figure 10:
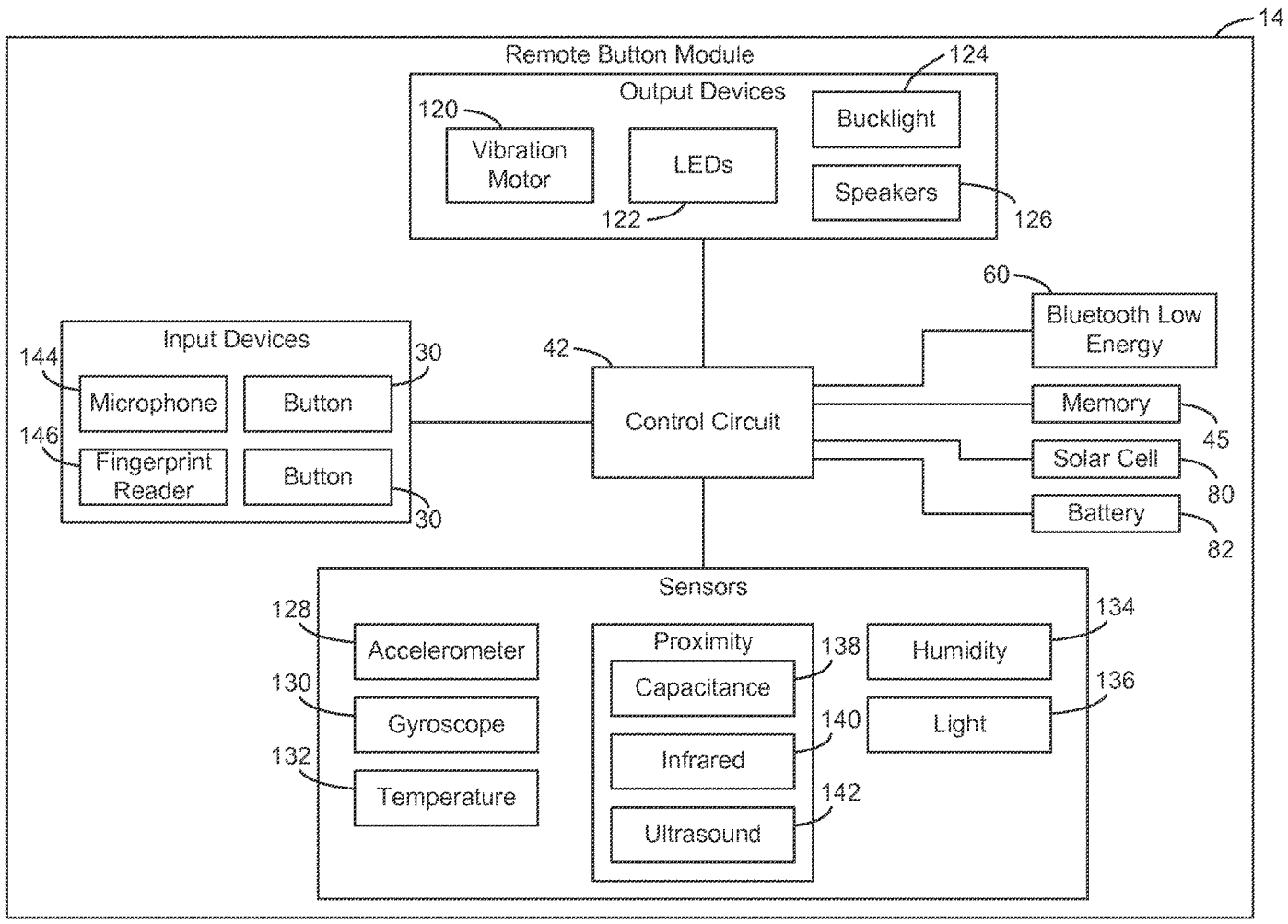
FIG. 10 illustrates a block diagram of the hardware corresponding to one embodiment of the remote button module.

FIG. 9 illustrates an embodiment of the remote button module 14 which includes additional components. With reference to FIGS. 9 and 10, the additional components described herein may be connected with the control circuit 42. The control circuit 42 may receive inputs from provide outputs to, control, or otherwise support the functions of the additional components described herein. In some embodiments, the remote button module 14 includes a vibration motor 120. The vibration motor 120 may provide haptic feedback to a user of the remote button module 14. For example, the vibration motor 120 may be activated upon the control circuit 42 receiving a user input, upon successful pairing or the remote button module 14 to a base station 16, after the distributed remote system 12 has been trained, paired with, or enrolled to operate with a home electronic device and/or remote device, etc. In additional embodiments, the remote button module 14 includes one or more LEDs 122. The LEDs 122 may display to the user information regarding the power remaining in the battery 82, that an input has been received, etc. Combinations of LEDs, color, blinking, etc. may be used to communicate information to the user. In other embodiments, the remote button module 14 includes backlighting sources 124. In further embodiments, the remote button module 14 includes one or more speakers 126 (e.g., piezoelectric device). Speakers 126 may be used to provide audio feedback to a user.

In some embodiments, the remote button module 14 may include one or more sensors. In some embodiments, the remote button module 14 includes an accelerometer 128. The accelerometer 128 may measure the movement of the remote button module 14. In some embodiments, the accelerometer 128 may detect user taps on the remote button module 14 (e.g., on a screen, the housing of the remote button module 14, a hard key button, etc.). The number of taps received may correspond to different functions of the remote button module 14. For example, if a defined number of taps are detected within a defined time window, the control circuit may put the remote button module 14 into a pairing mode which allows the base station 16 and/or a remote device to pair to the remote button module 14. In other embodiments, other input combinations place the remote button module 14 into a paring mode (e.g., spinning or rotating the remote button module 14, lowering the remote button module 14, raising the remote button module 14, changing the orientation of the remote button module 14, or otherwise physically interacting with the remote button module 14). In some embodiments, the number of taps may correspond to different functions of the remote button module 14. For example, if the remote user interface module is tapped two times, the remote button module 14 may control a remote device. If the remote button module 14 is tapped three times, the remote button module 14 may control a home electronic device. Taps may be used in combination with other user input devices in some embodiments. In some embodiments, the remote button module 14 includes a gyroscope 130, temperature sensor 132, humidity sensor 134, and/or light sensor 136. In some cases data gathered by one or more of these sensors may be displayed on the remote button module 14 and/or the trainable transceiver base station 16. For example, the remote button module 14 and/or base station 16 may display or otherwise output (e.g., audio output, data transmission, etc.) the temperature detected by the temperature sensor 132. In some embodiments, one or more of the sensor inputs may be used to control the remote button module 14 and/or the base station 16. For example, the brightness of a display on the remote button module 14 and/or the base station 16 may be adjusted according to the light intensity detected by the light sensor 136, backlighting 124 may be turned on in low light environments as detected by the light sensor 136, etc. Some embodiments of the remote button module 14 include one or more proximity sensors. For example, the remote button module 14 may include a projected capacitance sensor 138, infrared sensor 140, ultrasound sensor 142, etc. Input from a triggered proximity sensor may be used by the control circuit 42. For example, the control circuit 42, in response to a triggered proximity sensor, may turn on a display, activate backlighting, send a control signal, transmit data, send an instruction, etc.

In some embodiments, remote button module 14 includes input devices other than or in addition to buttons 30, touchscreen displays, capacitance based touch sensors, or other physical input devices. In some embodiments, the remote button module 14 includes one or more microphones 144. Microphones 144 may be used by the remote button module 14 to accept voice commands from a user. In some embodiments, the remote button module 14 may receive voice commands through a remote device (e.g., smartphone) with a microphone that is paired to the distributed remote system 12. In some embodiments, remote button module 14 includes fingerprint reader 146. Fingerprint reader 146 may be a touchscreen display, imager, or other device adapted to read a fingerprint of a reader. Alternatively, fingerprint reader 146 may be a dedicated device for identifying or reading fingerprints. Remote button module 14 may use input from fingerprint reader 146 to identify a user. The identity of the user may be used as a security measure to prevent unauthorized users from using remote button module 14. The identity of the user may be used to set user specific preferences for remote button module 14 (e.g., assigning specific inputs to specific actions). For example, the identity of the user may be used to assign specific buttons 30 or other input devices to control specific home electronic devices 20 and/or remote devices 22.

In some embodiments, the base station 16 may include one or more of the additional components described with reference to FIGS. 9 and 10 above. Remote button module 14 and/or base station 16 may include various subset of the previously described components in various embodiments.

Generally, the hardware components described above may form a human machine interface for interaction between the distributed remote system 12 and the user. Human machine interface techniques supported by the hardware of the remote button module 14 and/or the base station 16 may include providing user feedback or interactions. User feedback or interactions may include visual feedback through a display (e.g., touchscreen, LCD screen, etc.), audio voice prompts (e.g., an audio prompt to provide a voice command), backlighting or other lighting (e.g., in response to a system event or user input), haptic feedback, etc. Human machine interface techniques supported by the hardware of the remote button module 14 and/or the base station 16 may include receiving user inputs as previously discussed. In addition, some embodiments of the distributed remote system 12 may support user inputs such as gestures performed suing a touchscreen, voice commands (e.g., provided in response to an audio prompt triggered by pressing an holding a user input device), etc.

Generally and with reference to FIGS. 11A-11F, the distributed remote system 12 sends control signals to home electronic devices and/or remote devices using control data corresponding to the device to be controlled by the control signal. The control signal may include an activation signal, control data, data, a control instruction, or other control information. The control signal may be digitally processed or may be processed as an analog signal. The control signal may contain encryption information and/or be encrypted (e.g., according to a rolling code encryption technique or other encryption technique discussed herein). For the distributed remote system 12 to control home electronic devices and/or remote devices, the distributed remote system 12 is trainable. The distributed remote system 12 may be trained to control a device. The distributed remote system 12 may also be enrolled with a home electronic device and/or remote device to operate with the home electronic device and/or remote device.

Figure 11A:
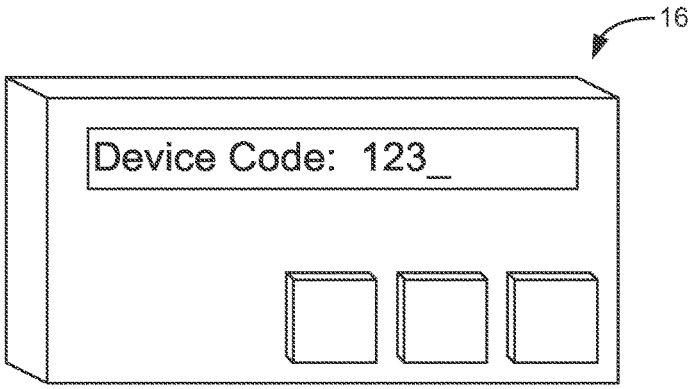
FIG. 11A illustrates one embodiment of a method of training the distributed remote system using a code entered on the base station.

FIG. 11A illustrates one embodiment of a method of training the distributed remote system 12. The user may input a code corresponding to a home electronic device or remote device into the base station 16. This code may correspond to encryption data which the distributed remote system 12 may access from memory and use to send control signals to the corresponding device. In some embodiments, the code may be provided by a table included with the distributed remote system 12. In other embodiments, the code may be included with a home electronic device or remote device (e.g., included on the device or in the device manual). In some embodiments, the code may be a seed value or correspond to seed value stored in memory. This may allow the distributed remote system 12 to be trained to send a control signal to a home electronic device or remote device which uses a rolling code.

Figure 11B:
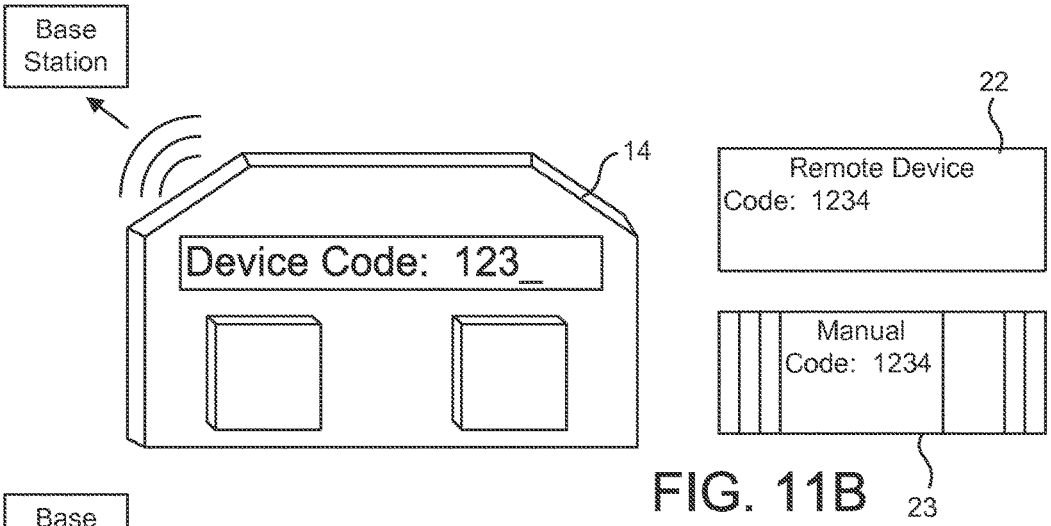
FIG. 11B illustrates one embodiment of a method of training the distributed remote system using a code entered on the remote button module.
Figure 11C:
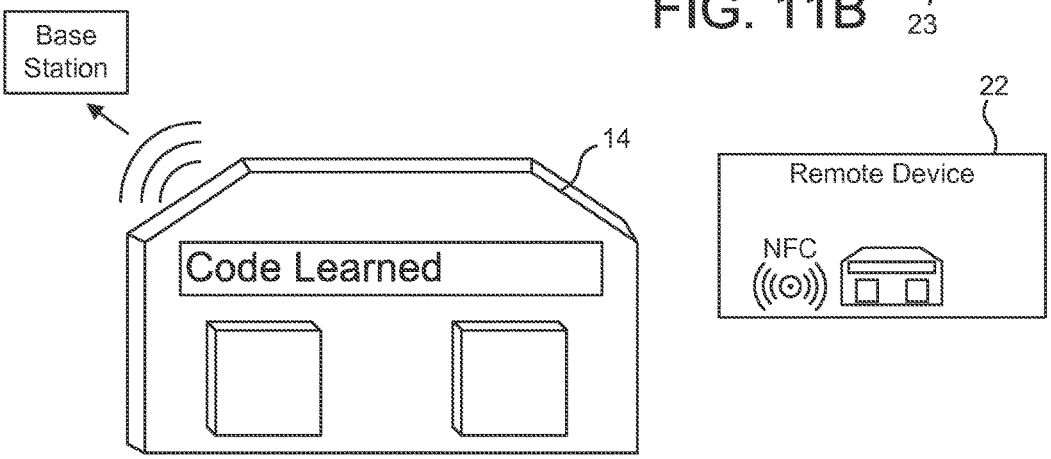
FIG. 11C illustrates one embodiment of a method of training the distributed remote system using near field communication.

FIG. 11B illustrates one embodiment of a method of training the distributed remote system 12. A code, such as the one described above with reference to FIG. 11A, may be input into the distributed remote system 12 using a remote button module 14 paired with the base station 16. A user may enter the device code using the remote button module 14. Advantageously, this allows the user to read the device code from the device 22 or from the device manual 23 and enter the code into the distributed remote system 12 without having to travel back to the vehicle 10. In other embodiments (e.g., where the trainable transceiver base station 16 is battery powered), the user may enter the code into the base station 16 without returning to the vehicle 10. The remote button module 14 may store the entered device code in memory. This allows the remote button module 14 to transmit the device code to the base station 16 when the remote button module 14 is in transmission range with the base station 16. In other embodiments, the device code may be transmitted to the base station 16. In further embodiments (e.g., embodiments in which the remote button module 14 transmits control signals which are retransmitted by the base station 16), the remote button module 14 may store the device code in memory and not transmit it to the base station 16. The code allows the distributed remote system 12 to be trained as discussed with reference to FIG. 11A FIG. 11C illustrates one embodiment of a method of training the distributed remote system 12. In some embodiments, the distributed remote system 12 may be trained to send control signals to a remote device and/or home electronic device using NFC. For example, the remote button module 14 may be brought into transmission range of a home electronic device and/or remote device 22 which is configured to communicate using NFC. The remote button module 14 may then receive, using NFC, the information necessary to control the device though control signals (e.g., operating codes, encryption information, device identification information, and/or other control information). The remote button module 14 may store the information in memory. This allows the remote button module 14 to transmit the information to the base station 16 when the remote button module 14 is in transmission range with the base station 16. In other embodiments, the information may be transmitted to the base station 16. In further embodiments (e.g., embodiments in which the remote button module 14 transmits control signals which are retransmitted by the base station 16), the remote button module 14 may store information in memory and not transmit it to the base station 16. The information allows the distributed remote system 12 to be trained.

Figure 11D:
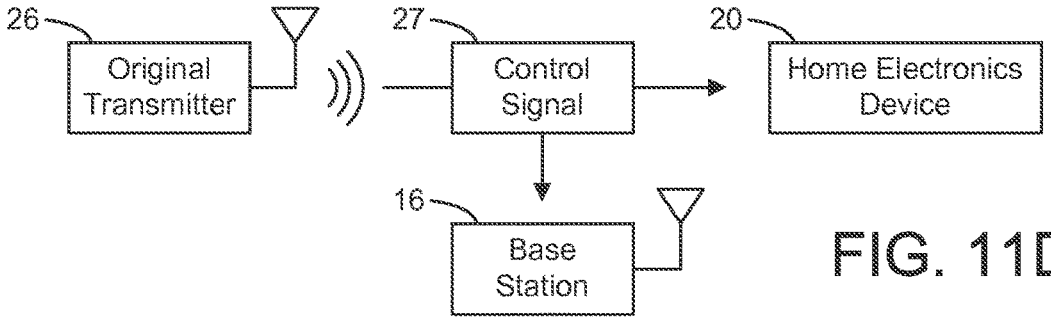
FIG. 11D illustrates one embodiment of a method of training the distributed remote system using automatic learning and the base station.
Figure 11E:
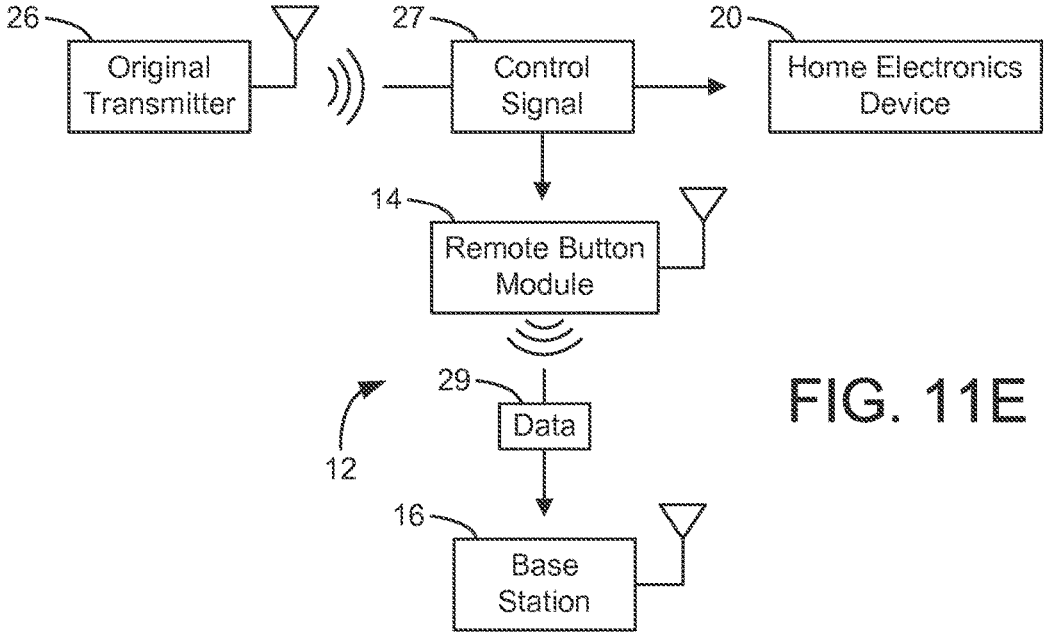
FIG. 11E illustrates one embodiment of a method of training the distributed remote system using automatic learning and the remote button module.

With reference to FIGS. 11D and 11E, the distributed remote system 12 may automatically learn control information from a control signal transmission of an original transmitter 26 which is received by the distributed remote system 12. The control circuit 42 of the remote button module 14 and/or the control circuit 52 of the base station 16 may analyze the control signal 27 received from the original transmitter 26 in order to automatically train the distributed remote system 12. FIG. 11D illustrates an embodiment of the distributed remote system 12 in which the control signal 27 from the original transmitter 26 is received by the base station 16 and used to automatically learn the control information for the home electronic device 20 or remote device associated with the original transmitter 26. This allows the base station 16 to train the distributed remote system 12. FIG. 11E illustrates and embodiment of the distributed remote system 12 in which the control signal 27 from the original transmitter 26 is received by the remote button module 14. For example, the remote button module 14 may include an ISM transceiver or receiver for receiving transmissions from original transmitters 26. The remote button module 14 may then transmit the control signal 27 from the original transmitter 26 and/or data 29 regarding the control signal to the base station 16. The distributed remote system 12 may use this control signal 27 and/or data 29 to train the distributed remote system 12 to send control signals 27 to the home electronic device 20 or remote device controlled by the original transmitter 26.

Figure 11F:
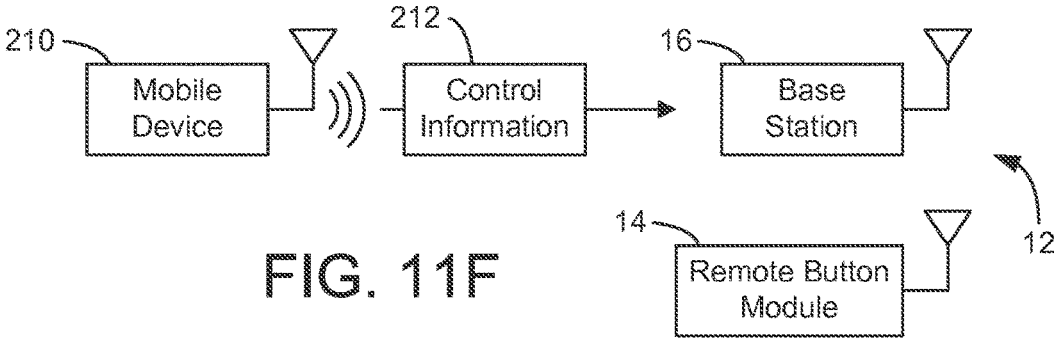
FIG. 11F illustrates one embodiment of a method of training the distributed remote system using a mobile device.

FIG. 11F illustrates one embodiment of a method of training the distributed remote system 12. A mobile device 210 (e.g., a smart phone, tablet, laptop computer, or other portable computing device) which is paired to the distributed remote system 12 (e.g., the remote button module 14 and/or the base station 16) may provide information 212 to the distributed remote system 12 for controlling a home electronic device and/or remote device. For example, the information 212 may include operating codes, encryption information, device identification information, and/or other information. In one embodiment, the mobile device 210 may provide this information using NFC to either the remote button module 14 or the base station 16. In some embodiments, the mobile device 210 may acquire the information from the remote device and/or home electronic device via communication with the device. In other embodiments, the mobile device 210 may acquire the information through an application, program, database stored in memory, user input, the internet, a combination of these sources, or another source of information. For example, a user may launch an application on a smart phone which prompts the user to pair the smart phone to the distributed remote system 12 if it is not already paired. The application may allow a user to input information about the home electronic device or remote device the user wants to control with the distributed remote system 12. For example, this information may include the type of device, make, model, identification information, MAC address, etc. The application may then retrieve control signal information stored in memory of the smart phone and/or retrieve control signal information using an internet connection (e.g., from a server containing control information). The application may then send the control information to the distributed remote system 12. The distributed remote system 12 may use the information to be trained or otherwise learn the control information 212.

Figure 11G:
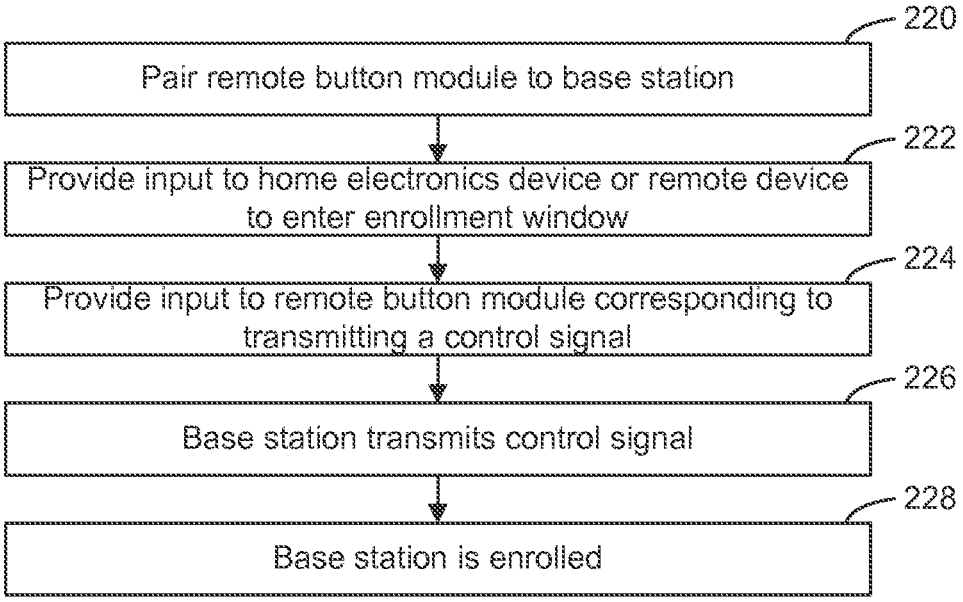
FIG. 11G illustrates one embodiment of a method of enrolling the distributed remote system with a home electronics device or remote device.

FIG. 11G illustrates a flow chart for one embodiment of a method of enrolling the distributed remote system 12 with a home electronic device and/or remote device. A user may pair the remote button module 14 to the base station 16 (step 220). The user may then take the remote button module 14 with himself or herself to the home electronic device or remote device. The user may then provide an input to the home electronic device or remote device to cause the device to enter an enrollment window (step 222). During the enrollment window, the home electronic device and/or remote device may receive a transmission from a remote control which allows the remote control to send control signals to the device after the closing of the enrolment window. During the enrolment window, a user may provide an input to the remote button module 14 (step 224) which causes the base station 16 to transmit a control signal (step 226). The control signal is received by the home electronic device and/or remote device during the enrolment window. The home electronic device and/or remote device then enrolls the distributed remote system 12 as a remote control that can control the device via control signal transmissions (step 228).

Figure 12A:
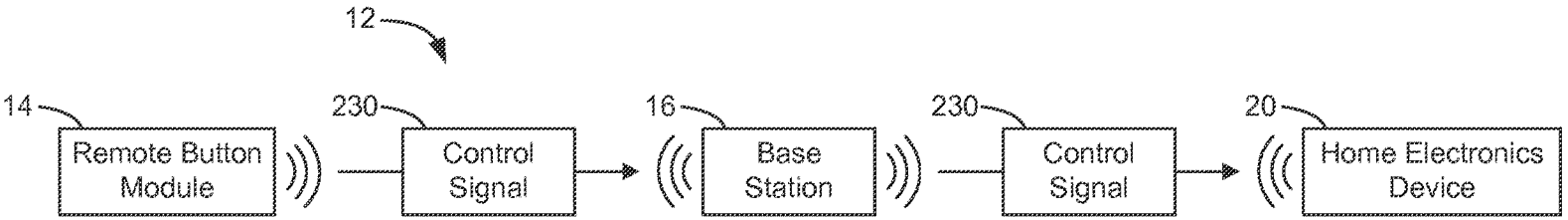
FIG. 12A illustrates an embodiment of the distributed remote in which the remote button module sends control signals to the base station.
Figure 12B:
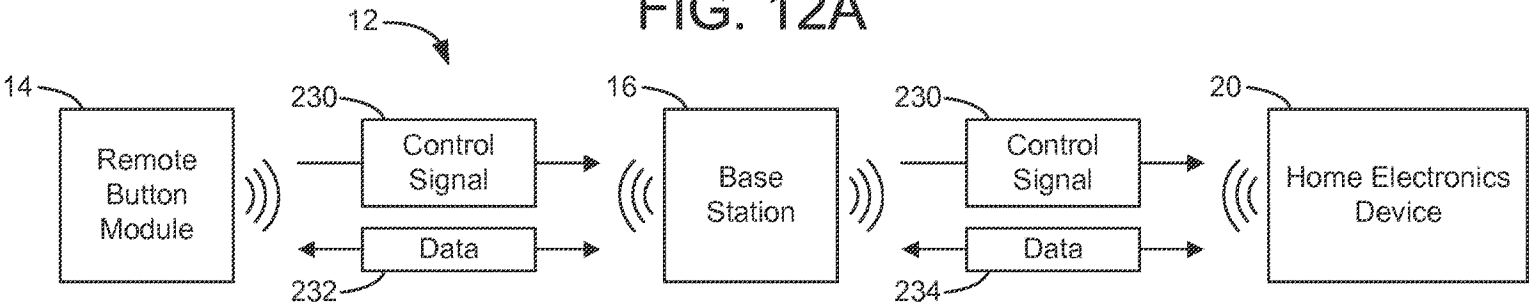
FIG. 12B illustrates an embodiment of the distributed remote system in which data is transmitted between the remote button module and the base station.
Figure 12C:
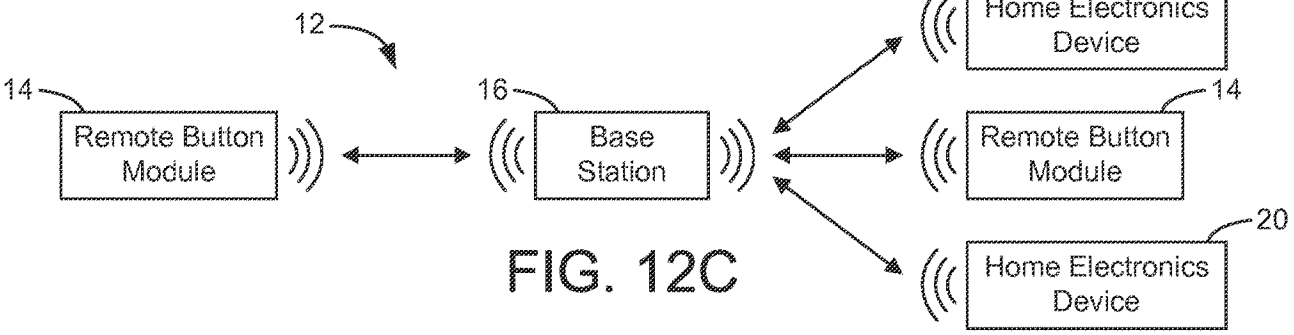
FIG. 12C illustrates an embodiment of the distributed remote system in which the base station transmits data and/or control signals to multiple devices.

With reference to FIGS. 12A-12C, the distributed remote system 12 may send control signals 230 to home electronic devices and/or remote devices for which the distributed remotes system has been trained and/or enrolled. In some embodiments, the distributed remote system 12 may exchange data (e.g., transmit and receive) with a home electronics device and/or remote device. FIG. 12A illustrates an embodiment of the distributed remote in which the remote button module 14 sends control signals 230 to the base station 16. The base station 16 may then retransmit the control signal 230 to one or more home electronic devices 20 and/or remote devices. In other embodiments, the remote button module 14 may transmit a signal containing data such as input received by the remote button module 14. The base station 16 may then process the input and generate a corresponding control signal (e.g., an input is received from the remote button module 14 of a user pushing the second of three buttons and the base station 16 generates a control signal for activating a second of three garage door openers). The base station 16 may then transmit the control signal. FIG. 12B illustrates an embodiment of the distributed remote system 12 in which data 232 is transmitted between the remote button module 14 and the base station 16. The data 232 may include user inputs, system statuses, device status or information, etc. In some embodiments, the base station 16 may transmit and/or receive data 234 from home electronic devices 20 and/or remote devices. This data 234 may be transmitted to the remote button module 14. For example, a home electronic device 20 may transmit data about its status (e.g., garage door open) to the base station 16. The base station 16 may transmit this data to the remote button module 14. In some embodiments, the remote button module 14 may process this data. For example, the remote button module 14 may process the data and display text and/or an icon to the user indicating the garage door is open. FIG. 12C illustrates an embodiment of the distributed remote system 12 in which the base station 16 transmits data and/or control signals to multiple devices.

Figure 13A:
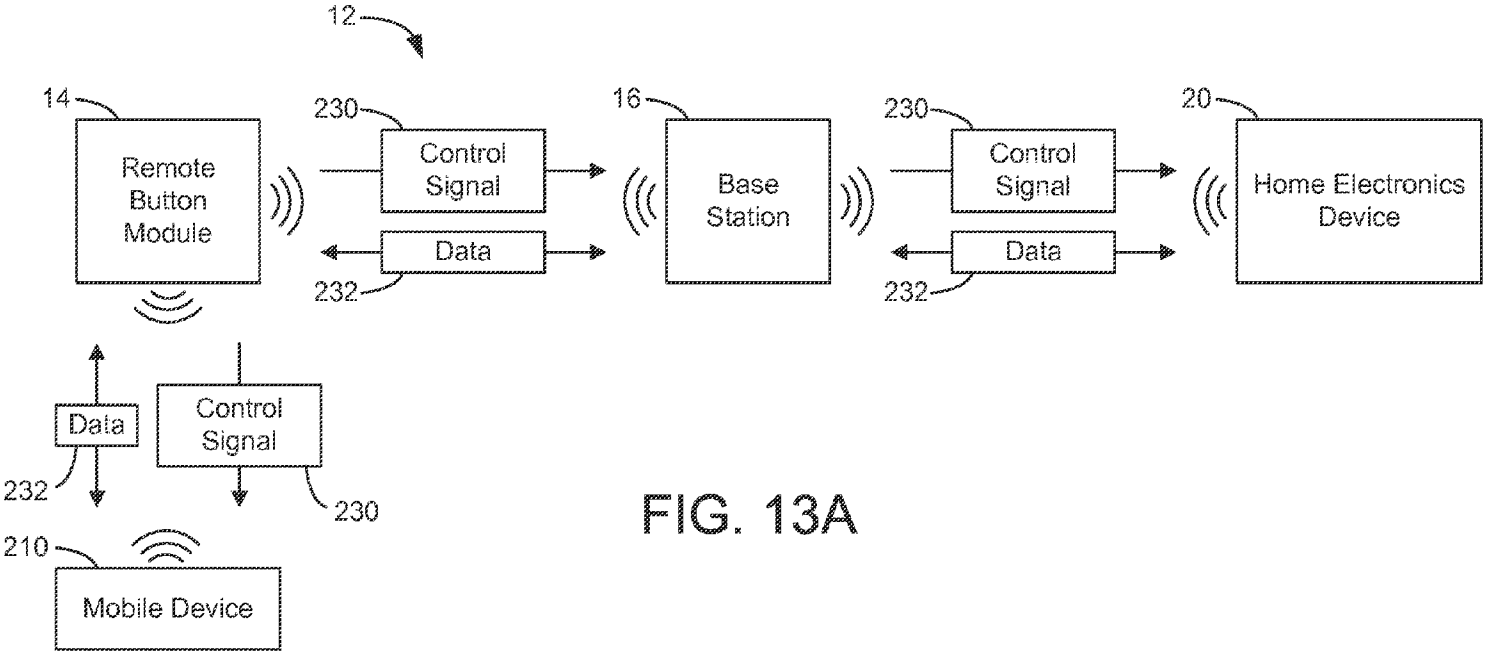
FIG. 13A illustrates a mobile device connected to the remote button module of the distributed remote system according to an exemplary embodiment.

Referring now to FIG. 13A, a mobile device 210 may be connected to the distributed remote system 12. In one embodiment, the mobile device 210 connects to the distributed remote system 12 through the remote button module 14. For example, the remote button module 14 and the mobile device 210 may be paired and communicate using a Bluetooth protocol. In some embodiments, the mobile device 210 may generate control signals 230 and/or data 232 and transmit the control signals 230 and/or data 232 to the remote button module 14. The remote button module 14 may transmit control signals 230 and/or data 232 to the base station 16, and the base station 16 may transmit the control signals 230 and/or data 232 to a home electronics device 20 and/or a remote device. In some embodiments, the mobile device 210 may also receive data 232. For example, a user may generate a control signal using a smart phone application and transmit it to the remote button module 14. The control signal may be transmitted to the base station 16 and then to a home electronics device. The home electronics device may transmit status data back to the mobile phone through the base station 16 and the remote button module 14. For example, this may result in a user closing a garage door by generating a control signal on a smart phone and receiving confirmation that the garage door has been closed from the garage door opener. The confirmation may be text and or images displayed in the application on the smart phone. In other embodiments, the control signal may be generated by the remote button module 14 based on an input received form the mobile device. In further embodiments, the base station 16 may generate the control signal based on an input received from the remote button module 14 which in turn received the input from the mobile device.

Figure 13B:
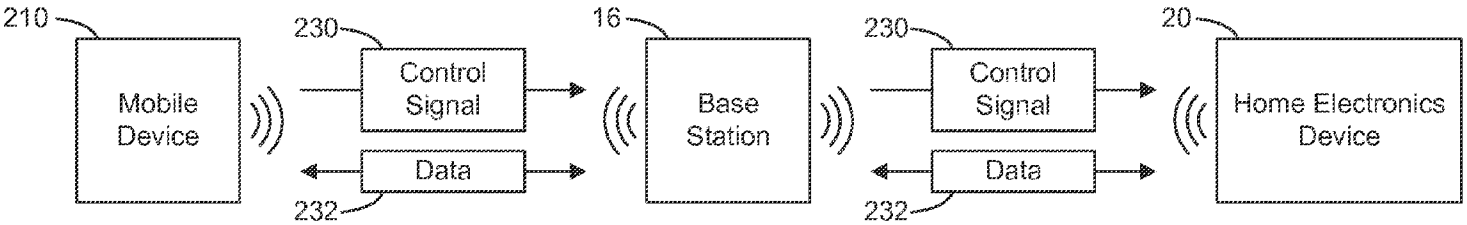
FIG. 13B illustrates a mobile device connected to the base station of the distributed remote system according to an exemplary embodiment.

With reference to FIG. 13B, a mobile device 210 may connect to a base station 16 of a distributed remote system 12. In some embodiments, the mobile device 210 may replace the remote button module 14. The mobile device 210 may have some or all of the functions described herein with respect to the remote button module 14.

Figure 13C:
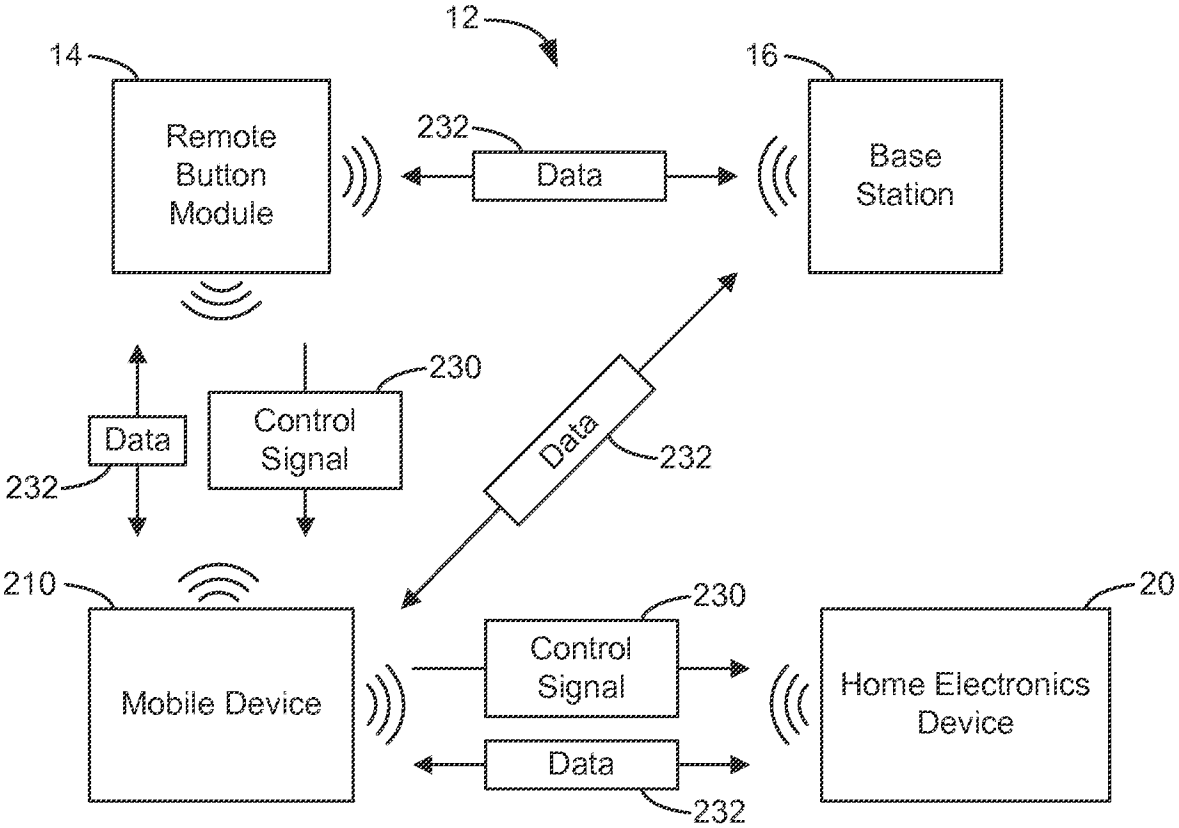
FIG. 13C illustrates a mobile device connected to the distributed remote system according to an exemplary embodiment.

Referring now to FIG. 13C, in some embodiments the mobile device 210 may send a control signal 230 to one or more home electronics devices 20 and/or remote devices. The mobile device 210 may send a control signal 230 based on inputs, data, and/or control signals received from a remote button module 14 connected to the mobile device 210. In other embodiments, the mobile device 210 may generate a control signal 230 based on input from one or more of the remote button module 14 and the base station 16.

Generally, the remote button module 14 may have additional functions when connected to a mobile device 210. For example, the remote button module 14 may serve as an input device to the mobile device 210. The inputs received by the mobile device 210 from the remote button module 14 may be used to trigger different functions of the mobile device 210 and/or be used by applications running on the mobile device 210. For example, the remote button module 14 may provide button press inputs to a smart phone. The smart phone may be running an application or otherwise be programmed such that when a button press input is received from the remote button module 14, the smart phone takes a picture with an onboard camera. In other embodiments, the remote button module 14 may have additional functions with respect to a connected base station 16. For example, an input received by the base station 16 from the remote button module 14 may cause the base station 16 to switch on or off USB or 12 volt charging of the base station 16 and/or pass through charging.

Home electronic devices are referred to herein. Home electronic devices are not exclusively used in relation to a residence. Home electronic devices may include commercial devices, devices used by government institutions, defense devices, or other devices not used in or associated with a home or residence. For example, home electronic devise may include gates on a commercial property, lighting in a vacation home, an industrial heating ventilation and air conditioning system associated with a commercial building, or other device.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can include RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A system for installation in a vehicle and for controlling a remote device, comprising:

a trainable transceiver base station configured to be mounted in the vehicle at a first location; and a remote button module separated from the trainable transceiver base station and configured to be mounted in the vehicle at a second location, the remote button module including a user input device, wherein the remote button module is configured to:

receive a wireless control signal for controlling the remote device from a wireless transmitter;

analyze the received wireless control signal to determine control information for sending an activation signal to cause a remote device action;

store the control information in memory of the remote button module;

wirelessly transmit the control information stored in the memory to the trainable transceiver base station for training the trainable transceiver base station;

receive a user input at the user input device, the user input indicating the remote device action;

generate a command signal based on the remote device action indicated by the user input;

wirelessly transmit the command signal to the trainable transceiver base station in response to receiving the user input; and wherein the trainable transceiver base station is configured to respond to receiving the command signal by transmitting the activation signal to the remote device, wherein the activation signal is formatted based on the command signal and the control information to control the remote device to perform the remote device action indicated by the user input.

2. The system of claim 1, wherein the command signal is transmitted using a first communications protocol and wherein the activation signal is transmitted using a second communications protocol.

3. The system of claim 2, wherein the remote button module and the trainable transceiver base station include a first pair of transceivers configured to transmit and receive using the first communications protocol, and wherein the trainable transceiver base station includes a second transceiver configured to transmit and receive using the second communications protocol.

4. The system of claim 2, wherein transmissions according to the first communications protocol uses less power than transmissions according to the second communications protocol.

5. The system of claim 2, wherein transmissions according to the second communications protocol have a greater range than transmissions according to the first communications protocol.

6. The system of claim 1, wherein the trainable transceiver base station comprises an interface for receiving power from a vehicle power system.

7. The system of claim 6, wherein the interface is at least one of a 12 volt power port or a USB interface.

8. The system of claim 1, wherein the user input device of the remote button module comprises at least one of a touch screen or a button.

9. The system of claim 1, wherein the remote button module comprises a charging interface for receiving battery charging power from the trainable transceiver base station.

10. The system of claim 1, wherein the remote button module comprises an adhesive backing for attaching the remote button to the interior of the vehicle's windshield.

11. The system of claim 1, wherein the remote button module is powered by at least one of a battery, a rechargeable battery, or a solar cell.

12. The system of claim 1, wherein the system is configured to be trained to control the remote device based on a transmission from an original transmitter associated with the remote device, and wherein the transmission from the original transmitter is received at the trainable transceiver base station and at least one characteristic of the received transmission is stored in memory of the trainable transceiver base for use in formatting the activation signal.

13. A method for controlling a remote device from a vehicle, comprising:

receiving at a remote button module a wireless control signal for controlling the remote device transmitted from a wireless transmitter, the button module located at a first location within the vehicle;

learning control information for sending an activation signal to cause a remote device action from the wireless control signal;

storing the control information in memory of the remote button module;

transmitting the control information stored in the memory of the remote button module to a trainable transceiver base station located at a second location within the vehicle to train the trainable transceiver base station;

receiving a user input at a user input device of the remote button module, the user input indicating the remote device action;

in response to receiving the user input, generating a command signal based on the remote device action indicated by the user input and wirelessly transmitting the command signal from the remote button module to the trainable transceiver base station;

receiving at the base station the command signal from the remote button module;

transmitting, from the base station and using a transceiver circuit of the base station, an activation signal to the remote device, wherein the activation signal is formatted based on the command signal and the control information and wherein the activation signal is formatted based on the control information and the user input to control the remote device to perform the remote device action indicated by the user input.

14. The method of claim 13, further comprising:

coupling the remote button module to the vehicle at the first location; and coupling the base station to the vehicle at the second location, wherein the base station is configured to draw power from the vehicle.

15. The method of claim 13, further comprising:

receiving at the base station a transmission from the original transmitter; and storing in in memory at least one characteristic of the received transmission for use in formatting the activation signal.

16. The method of claim 13, further comprising:

storing in the memory of the remote button module at least one characteristic of the received wireless control signal for use in formatting the activation signal;

transmitting the at least one characteristic of the received wireless control signal from the remote button module to the base station; and storing in memory of the base station the at least one characteristic of the received transmission.

17. The method of claim 13, further comprising:

pairing the remote button module to the base station using at least one of a PIN or a physical connection between the remote button module and the base station.

18. The system of claim 13, wherein the command signal is transmitted using a first communications protocol, wherein the activation signal is transmitted using a second communications protocol, and wherein transmissions according to the first communications protocol use less power than transmissions according to the second communications protocol.

19. The system of claim 13, wherein the command signal is transmitted using a first communications protocol, wherein the activation signal is transmitted using a second communications protocol, and wherein transmissions according to the second communications protocol have a greater range than transmissions according to the first communications protocol.

* * * * *